US008302974B2

(12) United States Patent
Kline

(10) Patent No.: US 8,302,974 B2
(45) Date of Patent: Nov. 6, 2012

(54) ADAPTABLE MOBILITY AID DEVICE FOR LEVEL AND INCLINED WALKWAYS AND FOR STAIRS

(76) Inventor: Kevin Roger Kline, Paxinos, PA (US)

( * ) Notice: Subject to any disclaimer, the term of this patent is extended or adjusted under 35 U.S.C. 154(b) by 286 days.

(21) Appl. No.: 12/780,870

(22) Filed: May 15, 2010

(65) Prior Publication Data

US 2011/0278808 A1 Nov. 17, 2011

(51) Int. Cl.
*A61H 3/04* (2006.01)

(52) U.S. Cl. ..... 280/43; 280/87.021; 280/87.041; 135/69; 135/75

(58) Field of Classification Search ..... 280/87.01, 280/87.05, 87.021, 87.041, 267, 43, 43.1; 135/66–68, 69, 75; 482/66–69
See application file for complete search history.

(56) References Cited

U.S. PATENT DOCUMENTS

| | | | | |
|---|---|---|---|---|
| 2,563,436 | A | 8/1951 | Toth | |
| 3,249,368 | A | 5/1966 | Ginzburg | |
| 3,272,530 | A | 9/1966 | Klassen | |
| 3,354,893 | A | 11/1967 | Schmerl | |
| 3,387,617 | A * | 6/1968 | Reiber | 135/67 |
| 3,387,618 | A | 6/1968 | Swann | |
| 3,421,529 | A | 1/1969 | Vestal | |
| 3,422,830 | A | 1/1969 | Cherup | |
| 3,455,313 | A | 7/1969 | King | |
| 3,537,748 | A | 11/1970 | Knapp | |
| 3,800,815 | A * | 4/1974 | Birk | 135/67 |
| 3,836,160 | A | 9/1974 | Linsley | |
| 3,945,389 | A | 3/1976 | Smith | |
| 3,968,810 | A | 7/1976 | Thomas | |
| 3,993,349 | A | 11/1976 | Neufeld et al. | |
| 3,999,565 | A | 12/1976 | Delacour | |

(Continued)

FOREIGN PATENT DOCUMENTS

GB 2194731 A 3/1988

(Continued)

OTHER PUBLICATIONS http://www.target.com/Healthline-Adult-Walker-Anti-Slip-Tips/dp/B001FOMDO6/qid=1248661504/ref=br_1_14/192-0536052-1777520?ie=UTF8&node=14029651&frombrowse=1&rh=&page=1 Jul. 25, 2009.

(Continued)

*Primary Examiner* — J. Allen Shriver, II
*Assistant Examiner* — James Triggs
(74) *Attorney, Agent, or Firm* — Russ Weinzimmer; Russ Weinzimmer & Associates PC

(57) ABSTRACT

An adaptable mobility aid device is disclosed that has length-adjustable front and rear legs, a handle, and a knee support platform coupled to the legs and the handle, the legs being adjustable within a range of lengths suitable to straddle steps for ascending and descending stairways, as well as to function on the level, or on a ramp. The lengths of the legs can be adjusted in tandem via single-hand operability of an adjustment mechanism. The knee support platform provides support for an impaired lower leg of a user, not requiring the leg to contact the stairs, and also not requiring the leg to be held mid-air in a hopping motion. The handle enables one-handed use of the adaptable mobility aid device. In some embodiments, spring loaded pins or a pull bar to activate the pins, enable the single-hand operability of the adjustment mechanism.

20 Claims, 31 Drawing Sheets

U.S. PATENT DOCUMENTS

| | | | | |
|---|---|---|---|---|
| 4,046,374 | A | 9/1977 | Breyley | |
| 4,062,372 | A | 12/1977 | Slusher | |
| 4,094,331 | A | 6/1978 | Rozsa | |
| 4,291,715 | A * | 9/1981 | Monte | 135/68 |
| 4,310,166 | A | 1/1982 | Eicher | |
| 4,314,576 | A | 2/1982 | McGee | |
| 4,342,465 | A * | 8/1982 | Stillings | 280/87.051 |
| 4,411,283 | A | 10/1983 | Lucarelli | |
| 4,474,202 | A | 10/1984 | Blechner | |
| 4,550,802 | A | 11/1985 | Roper | |
| D288,996 | S | 3/1987 | Winzeler | |
| 4,722,538 | A | 2/1988 | Freyman | |
| 4,777,973 | A | 10/1988 | Nakajima | |
| 5,020,560 | A * | 6/1991 | Turbeville | 135/67 |
| 5,158,313 | A * | 10/1992 | Becker | 280/87.021 |
| 5,161,640 | A | 11/1992 | Holbrooks et al. | |
| 5,349,977 | A | 9/1994 | Wood | |
| 5,411,035 | A | 5/1995 | Stone | |
| 5,603,517 | A | 2/1997 | Lorman | |
| 5,785,070 | A | 7/1998 | Block et al. | |
| 5,800,317 | A | 9/1998 | Accetta | |
| 5,839,740 | A * | 11/1998 | Seeger | 280/87.021 |
| 5,882,067 | A | 3/1999 | Carbajal et al. | |
| 5,957,146 | A * | 9/1999 | Corey | 135/65 |
| 6,053,189 | A | 4/2000 | Longenecker et al. | |
| 6,145,524 | A * | 11/2000 | Li et al. | 135/67 |
| 6,328,120 | B1 * | 12/2001 | Haussler et al. | 180/8.3 |
| 6,338,354 | B1 * | 1/2002 | Alexander | 135/67 |
| 6,453,921 | B1 | 9/2002 | Rost | |
| 6,595,530 | B2 | 7/2003 | Wood | |
| 6,626,200 | B1 | 9/2003 | Reedy | |
| 6,692,417 | B2 | 2/2004 | Burrell | |
| 6,705,336 | B2 | 3/2004 | Goligorski | |
| 6,820,949 | B1 | 11/2004 | Caruso | |
| 6,848,696 | B2 | 2/2005 | Miller | |
| 6,959,716 | B1 | 11/2005 | Schrader | |
| D528,780 | S | 9/2006 | Karasin et al. | |
| 7,261,113 | B2 | 8/2007 | Tartaglia | |
| 7,287,767 | B1 | 10/2007 | Gomes et al. | |
| 7,311,319 | B1 | 12/2007 | Ortega | |
| 7,363,931 | B2 | 4/2008 | Weaver | |
| 7,476,187 | B2 | 1/2009 | Corte | |
| 7,490,617 | B2 | 2/2009 | Bell et al. | |
| 7,509,966 | B2 | 3/2009 | Karasin et al. | |
| 7,780,180 | B2 * | 8/2010 | Hoepner et al. | 280/267 |
| 8,151,812 | B2 * | 4/2012 | Razon | 135/66 |
| 2005/0211285 | A1 * | 9/2005 | Cowie et al. | 135/74 |
| 2005/0279392 | A1 | 12/2005 | Lapierre | |
| 2006/0033297 | A1 | 2/2006 | Miller | |
| 2009/0194142 | A1 * | 8/2009 | Zimmerman | 135/67 |
| 2011/0240076 | A1 * | 10/2011 | Hateley | 135/66 |

FOREIGN PATENT DOCUMENTS

| | | | |
|---|---|---|---|
| JP | 05111548 | A2 | 5/1993 |
| JP | 08089322 | A2 | 4/1996 |
| JP | 09294789 | A2 | 11/1997 |
| SE | 0519276 | C2 | 2/2003 |
| WO | 9934761 | A1 | 7/1999 |
| WO | 2005020867 | A1 | 3/2005 |
| WO | 2005110328 | A1 | 11/2005 |

OTHER PUBLICATIONS http://www.ez-step.com/ Jul. 25, 2009 EZ-Step.
http://www.activeforever.com/p-1744-iwalkfree-hands-free-crutch.aspx?intcmp=search Jul. 25, 2009.
http://www.specialtymedicalsupply.com/pvc-walkers/ Stroller Walker Jul. 25, 2009.
https://01a731e.netsolstores.com/index.asp?PageAction=VIEWPROD&ProdID=567 Jul. 25, 2009 Knee Walker™.
http://www.thirdwheelortho.com/index.htm Jul. 25, 2009 Third Wheel Orthopedics, LLC.
http://www.maxiaids.com/store/prodView.asp?idproduct=1849&idstore=6&idCategory=219&category=Walker_Accessies&product=Seat_For_Walker Jul. 25, 2009.

* cited by examiner

ADAPTABLE MOBILITY AID DEVICE FOR LEVEL AND INCLINED WALKWAYS AND FOR STAIRS

TECHNICAL FIELD

This invention relates generally to mobility aid devices, and more particularly to adaptable mobility aid devices.

BACKGROUND

Reduced mobility is a common plight of individuals with lower leg injuries or individuals who are recovering from lower leg surgery, particularly older individuals. Walkers have been used for decades as aids to improve mobility and sometimes as well to promote healing for leg, ankle, and foot injuries or surgeries. Typically, a walker has four legs with end caps and a structure or frame that surrounds a user's front and sides during use. Some walkers include two or more wheels or casters instead of end caps to make movement of the walker easier. These typical walkers are adequate as walking aids, but in many situations, a user must prevent contact with the floor by an injured foot or ankle. In these circumstances, a user can use only the good leg for bearing weight. Thus, in order to use a typical walker, the user is obliged to use a "step-hop-step-hop- . . . " gait with the healthier leg, an unnatural and uncomfortable manner of getting around. Furthermore, hopping can be difficult or impossible for some older or heavier individuals.

Besides a user's need to hop, other problems are encountered when using a conventional walker. As a prime example, due to their design for use on level or flat walkways, walkers are generally of little use on stairs. They are unstable and unwieldy on stairs at best, and often cannot be used at all on stairs, due to the distance separating front and rear legs being wider than a typical stair step depth. Moreover, the problem of hopping is exacerbated when the individual using a walker needs to climb or descend stairs. This can happen frequently, since stairs are often encountered when a user visits a doctor's office, a physical therapist, and even in some cases, around the home.

Various attempts have been made to modify walkers for use on stairs. These modified walkers, or other mobility aid devices that can be used on stairs, generally have been unwieldy and/or unsuitable for use on a flat walkway. For example, some mobility aid devices have sets of legs with feet or skids at the bases of the legs with the feet or skids parallel to the forward direction of motion of the walker. These sets of legs and feet are configured to fit on two or three stair steps at a time. Some other devices require a complicated series of adjustments for the leg lengths to accommodate stair riser heights or user height. For example, each leg may require loosening of a threaded key or screw to enable adjustment of the length of that leg, and retightening of the key or screw to prevent subsequent undesired changes in length. Having to do this at the foot of a stairway, and then again at the top of a stairway, can be arduous for someone required to stand on only one leg during the adjustment process.

Some modified walkers have included a pad for support of a user's knee or lower leg during use of the walker. These walkers are either unsuitable for use on stairs, or are difficult to adjust between use on stairs and use on level walkways.

SUMMARY

A adaptable mobility aid device is claimed that has length-adjustable front and rear legs, a handle, and a knee support platform coupled to the legs and the handle, so that the front legs can be adjusted between a length for use on stairs and a length for use on a level walkway. The legs are configured so that, when the device is used on stairs, the front leg engages an upper step and the rear leg engages a lower step so as to support the knee support platform in a substantially horizontal position. Lengths of the legs can be adjusted via single-hand operability of an adjustment mechanism. The legs can be adjusted within a range of lengths suitable for walking on a level walkway, and for ascending and descending stairs. The knee support platform provides support for an injured or impaired lower leg of a user to prevent contact of that leg's foot with the walkway or stairs. The handle enables one-handed use of the adaptable mobility aid device, and the knee support platform enables use of the adaptable mobility aid device without the user having to hop on one foot during use.

In preferred embodiments, the adaptable mobility aid device can have two front legs and two rear legs. In some preferred embodiments, the device can have as few as one front leg and as few as one rear leg. The knee support platform can have a flat upper surface, and can be used as a seat, for example, when a user wishes to pause for resting during climbing or descending stairs, or during walking on a level surface. To enhance the use of the device as a seat for resting, the device can include a back support frame on which the handle can be situated. In some preferred embodiments, the adaptable mobility aid device also includes a back support surface that substantially spans the back support frame.

In certain preferred embodiments, the adaptable mobility aid device includes an adjustable coupling, with the legs including a sleeve portion and a nesting portion. In preferred embodiments, the adaptable mobility aid device is collapsible for storage, for example, in a closet, or in an automobile or other vehicle, or for use as a cane. And in some preferred embodiments, the front and rear legs include wheels, with the device including a brake that can be activated to secure the front wheels against rolling.

One general aspect of the present invention is a adaptable mobility aid device that includes the following elements:

a knee support platform having an upper surface;

a handle coupled to the knee support platform;

at least one rear leg coupled to the knee support platform, the at least one rear leg configured to engage a walking surface by frictional contact; and at least one front leg coupled to the knee support platform, the at least one front leg configured to engage the walking surface by frictional contact, the at least one front leg being length-adjustable between a first length for use of the device on stairs, and a second length for use on a level walkway, and the at least one front leg configured so that, when the device is used on stairs, the front leg engages an upper step and the rear leg engages an adjacent lower step so as to support the knee support platform in a position over a portion of the upper step and over a portion of the adjacent lower step, with the knee support platform disposed approximately horizontally.

In preferred embodiments the knee support platform has a contoured upper surface. And in certain preferred embodiments the knee support platform is adapted for use as a seat. Furthermore, in some preferred embodiments the handle is on an opposite side of the knee support platform as a user when the device is in use for walking or climbing. In various preferred embodiments the device has a front side with which the at least one front leg is coupled, and the handle forms a portion of the front side. In some preferred embodiments the at least one rear leg is a single rear leg, and the at least one front leg is a single front leg.

In certain preferred embodiments, the device further includes a front adjustability mechanism configured to enable length adjustment of the at least one front leg, and configured for single-hand operability, and also includes a rear adjustability mechanism configured to enable length adjustment of the at least one rear leg, and configured for single-hand operability. In some of these preferred embodiments, the front adjustability mechanism includes an adjustable coupling configured to be single-hand operable, and the at least one front leg includes a sleeve portion and a nesting portion coupled to the sleeve portion via the adjustable coupling.

In some preferred embodiments the at least one front leg is a pair of front legs, and the at least one rear leg is a pair of rear legs, and the adaptable mobility aid device further includes:

an adjustability mechanism configured to enable adjustability of the pair of front legs, with the mechanism including:

a pair of sleeves coupled to the knee support platform, each sleeve configured to receive a corresponding leg of the pair of front legs for sliding motion;

a series of apertures defined in each of the pair of front legs;

a pair of pins, a pin disposed in each of the pair of sleeves, each of the pins configured to engage one aperture of the series of apertures defined in a corresponding one of the pair of front legs so as to secure the corresponding one of the pair of front legs against movement with respect to a corresponding sleeve of the pair of sleeves; and a spring-loaded bar coupled to the pair of pins, and configured so that when the bar is actuated each of the pins is disengaged from its aperture.

In preferred embodiments the at least one front leg, the at least one rear leg, and the knee support platform are configured to enable collapsibility of the device. In some of these preferred embodiments the at least one front leg is a pair of front legs, and the at least one rear leg is a pair of rear legs. Furthermore, the pair of front legs includes a left front leg and a right front leg, the pair of rear legs includes a left rear leg and a right rear leg, and the knee support platform is pivotally attached to the left front leg, the right front leg, the left rear leg, and the right rear leg. In these preferred embodiments, the adaptable mobility aid device also includes the following elements:

a left crossbrace pivotally attached to the left front leg and pivotally attached to the left rear leg, the left crossbrace including a pivot within a central portion of the left crossbrace to enable bending of the left crossbrace;

a right crossbrace pivotally attached to the right front leg and pivotally attached to the right rear leg, the right crossbrace including a pivot within a central portion of the right crossbrace to enable bending of the right crossbrace; and a rod having a left end and a right end, the rod connected to the left crossbrace at the left end to form the pivot of the left crossbrace, and connected to the right crossbrace at the right end to form the pivot of the right crossbrace;

in which a motion of the rod to cause bending of the left crossbrace and the right crossbrace enables folding of the device for storage. Moreover, some of these preferred embodiments that are configured to enable collapsibility also include the following elements:

a left floating clamp pivotally attached to the left crossbrace and configured to encircle the left front leg to enable sliding motion of the left front leg within the left floating clamp; and a right floating clamp pivotally attached to the right crossbrace and configured to encircle the right front leg to enable sliding motion of the right front leg within the right floating clamp;

in which, when a motion of the rod causes bending of the left crossbrace and the right crossbrace, the knee support platform is configured to fold, with sliding motion of the front legs within the corresponding floating clamps, so as to bring the rear legs close to the front legs for storage.

Another general aspect of the present invention is a adaptable mobility aid device that includes the following elements:

a pair of front legs configured to engage a walking surface by frictional contact, the pair of front legs being length-adjustable, the pair of front legs capable of adjustment to a first length for use on stairs and to a second length for use on a level walkway;

a front adjustability mechanism configured to enable length adjustability of the pair of front legs via single-hand operability;

a pair of rear legs configured to engage the walking surface by frictional contact, the pair of rear legs being length-adjustable;

a rear adjustability mechanism configured to enable length adjustability of the pair of rear legs via single-hand operability;

a back support frame coupled to the pair of front legs;

a knee support platform coupled to the pair of front legs, coupled to the pair of rear legs, and coupled to the back support frame; and a handle coupled to the back support frame.

In some preferred embodiments that include the back support frame, the back support frame includes a pair of support uprights coupled to the front legs and coupled to the handle, each of the support uprights defining an inside slot and a series of spaced apertures; the front legs are further configured to slide into the support uprights to enable length adjustability; and the front adjustability mechanism includes the following elements:

an adjusting bar coupled to the front legs;

a pair of spring-loaded pins, normally engaged with a pair of apertures; and an actuator disposed on the adjusting bar and configured to disengage the pins from the apertures.

Moreover, the device further includes a pair of springs disposed within the support uprights and configured to provide resisting force against shortening the length of the front legs.

In some other preferred embodiments that include the back support frame, the back support frame includes a left support upright and a right support upright coupled to the front legs and coupled to the handle, each of the support uprights defining an inside slot and an aperture; the left front leg defines a left series of spaced apertures; the right front leg defines a right series of spaced apertures; the front legs are further configured to slide into the support uprights to enable length adjustability; and the front adjustability mechanism includes the following elements:

an adjusting bar coupled to the front legs;

a left spring-loaded pin and a right spring-loaded pin, the left pin engaged with the aperture on the left support upright and normally engaged with an aperture of the left series of apertures, the right pin engaged with the aperture on the right support upright and normally engaged with an aperture of the right series of apertures; and an actuator disposed between the support uprights for sliding motion and configured to disengage the left spring-loaded pin from the aperture of the left series of apertures, and to disengage the right spring-loaded pin from the aperture of the right series of apertures. Moreover, the device further includes a pair of springs disposed within the support uprights and configured to provide resisting force against shortening the length of the front legs.

In some preferred embodiments that include the back support frame, the knee support platform has a flat upper surface, and the knee support platform is adapted for use as a seat. In certain preferred embodiments that include the back support frame, the handle is on an opposite side of the knee support platform as a user when the device is in use for walking or climbing.

In still other preferred embodiments that include the back support frame, the device further includes a back support surface coupled to the back support frame, and the pair of front legs is length-adjustable in tandem, the pair of rear legs is length-adjustable in tandem, and the knee support platform is adapted for use as a seat.

In yet other preferred embodiments that include the back support frame, the device further includes a pair of sleeves coupled to the pair of front legs, and an adjustable coupling; in which each of the pair of front legs includes a nesting portion coupled to its corresponding sleeve portion via the adjustable coupling, and the adjustable coupling is single-hand operable.

Still another general aspect of the present invention is a adaptable mobility aid device that includes the following elements:

a knee support platform;

a handle coupled to the knee support platform;

a pair of rear legs coupled to the knee support platform;

a pair of rear wheels coupled to the pair of rear legs, the pair of rear legs configured to engage a walking surface by rolling contact;

a pair of front legs coupled to the knee support platform, the pair of front legs being length-adjustable for use of the device on stairs, for use on a ramp, and for use on a level walkway, and the pair of front legs configured so that, when the device is used on stairs, the front legs engage an upper step and the rear legs engage an adjacent lower step so as to support the knee support platform in a position over a portion of the upper step and over a portion of the adjacent lower step, and with the knee support platform disposed approximately horizontally;

a pair of front wheels coupled to the pair of front legs, the pair of front wheels configured to engage the walking surface by rolling contact; and a brake coupled with the front legs, the brake configured for user operability to prevent rolling of the front wheels when the device is used on stairs.

In preferred embodiments that include the brake, the brake includes a park bar, the park bar being spring-loaded so that the front wheels are normally prevented from rolling, and the device further includes the following elements:

a cable coupled to the park bar, the cable configured to enable disengagement of the park bar from the front wheels to enable rolling of the front wheels; and a hand lever disposed near the handle, the hand lever coupled to the cable and configured to enable locking of the park bar via the cable to disengage the park bar from the front wheels, and further configured to enable unlocking of the park bar via the cable to engage the park bar with the front wheels.

BRIEF DESCRIPTION OF THE DRAWINGS

The invention will be more fully understood by reference to the detailed description, in conjunction with the accompanying figures, wherein.

DETAILED DESCRIPTION

FIG. 1A through FIG. 1E depict a sequence of steps that illustrate the use of an adaptable mobility aid device in a preferred embodiment on a level walkway.

Figure 1A:
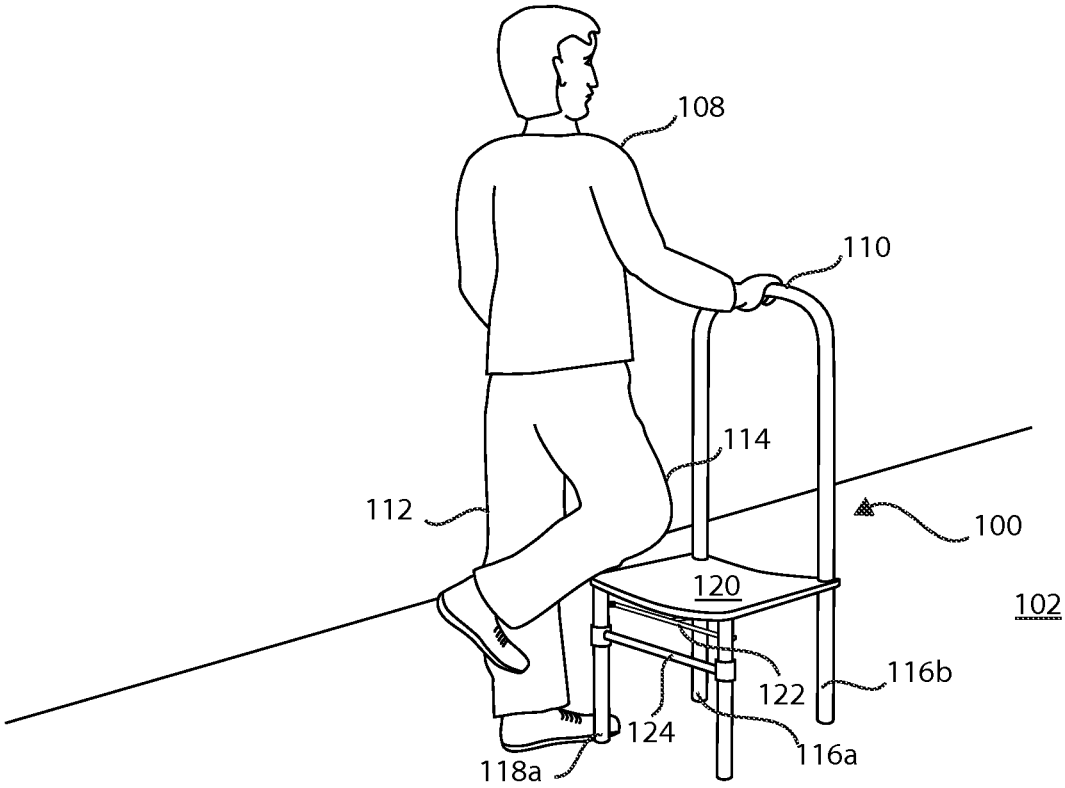
FIG. 1A is an oblique angle view of a preferred embodiment of the present invention in use as a adaptable mobility aid device on a level walkway, showing the device in place in a first position and a knee of a user about to be placed on a knee support platform.

FIG. 1A is an oblique angle view of a preferred embodiment of the present invention in use as an adaptable mobility aid device 100 on a level walkway 102, showing the device in place in a first position 106 and a knee 114 of a user 108 about to be placed on a knee support platform 120. The user 108 of the device 100 is gripping the handle 110 of the device, and is standing erect on a leg 112 with the knee 114 of the other leg bent. The leg 112 is hereinafter referred to as the good leg. The adaptable mobility aid device 100 provides stable support at this point in the sequence so that the user 108 can use the device for knee support during movement of the good leg 112.

Figure 10:
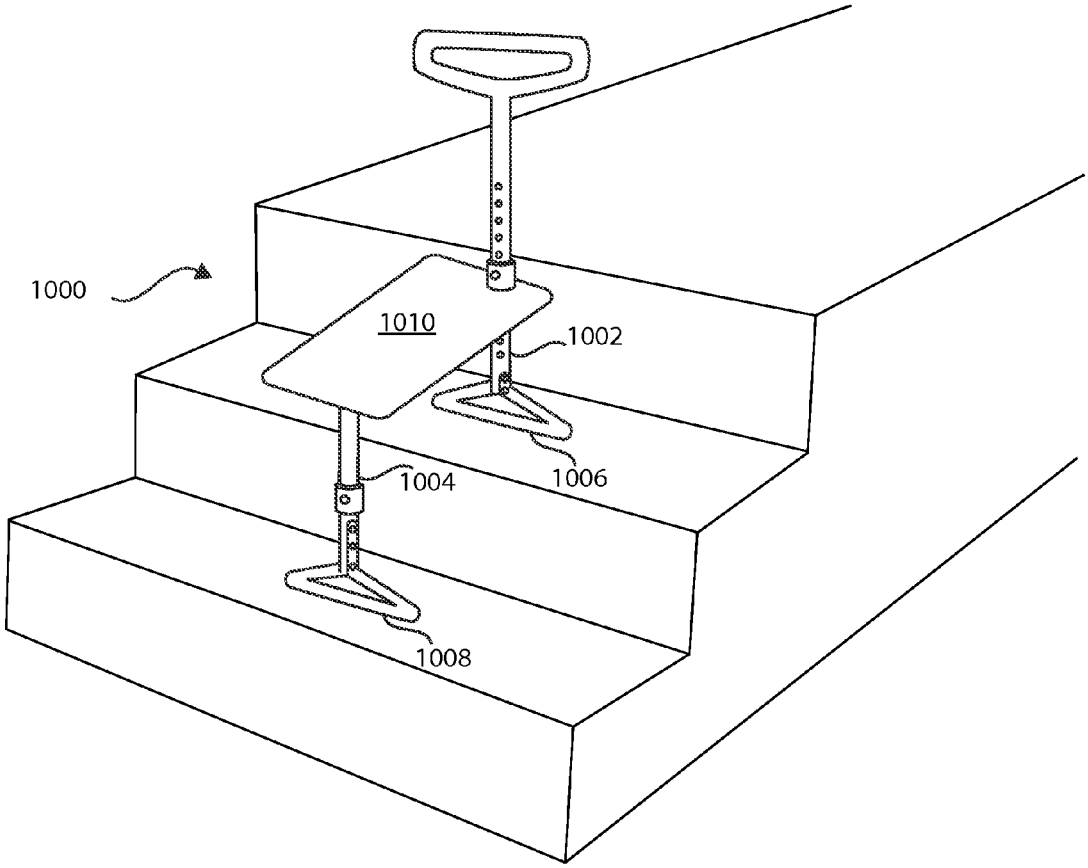
FIG. 10 is an oblique angle view of a preferred embodiment of the present invention, showing an adaptable mobility aid device having a single adjustable front leg and a single adjustable rear leg.

In the embodiment of FIG. 1A, the device 100 includes a pair of front legs 116*a* and 116*b*, a pair of rear legs 118*a* and 118*b*, as well as the knee support platform 120. As shown, the handle 110 is coupled to the knee support platform 120. In the embodiments described herein, the front legs 116*a* and 116*b* and the rear legs 118*a* and 118*b* are coupled to the knee support platform 120. In some preferred embodiments, the front legs 116*a* and 116*b* and the rear legs 118*a* and 118*b* are configured for frictional contact with a walkway and/or stairway. It is understood that embodiments of the present invention can have fewer than two front legs, for example, at least one front leg, and can have fewer than two rear legs, for example, at least one rear leg. FIG. 10, discussed below, shows an embodiment with one front leg and one rear leg. It is also understood that some embodiments can have three legs. In FIG. 1A, the device has a front side with which the at least one front leg is coupled, and the handle 110 forms a portion of the front side. Moreover, the at least one front leg and at least one rear leg are parallel, one with another.

In FIG. 1A, an adjustment mechanism (402, see FIGS. 4 and 4A), also referred to herein as an adjustability mechanism, can be activated by a spring-loaded pull bar 122 to enable length adjustability of the front legs 116*a* and 116*b*. In various preferred embodiments discussed below, the adjustment mechanism includes an adjustable coupling, and is single hand operable through single hand operability of the adjustable coupling. A separate adjustment mechanism 124, likewise also referred to herein as an adjustability mechanism, enables length adjustability of the rear legs 118*a* and 118*b*. By use of the adjustment mechanisms 402 and 124, the device 100 can be adjusted so that the knee support platform 120 is at a comfortable height for use by the user 108.

Figure 1B:
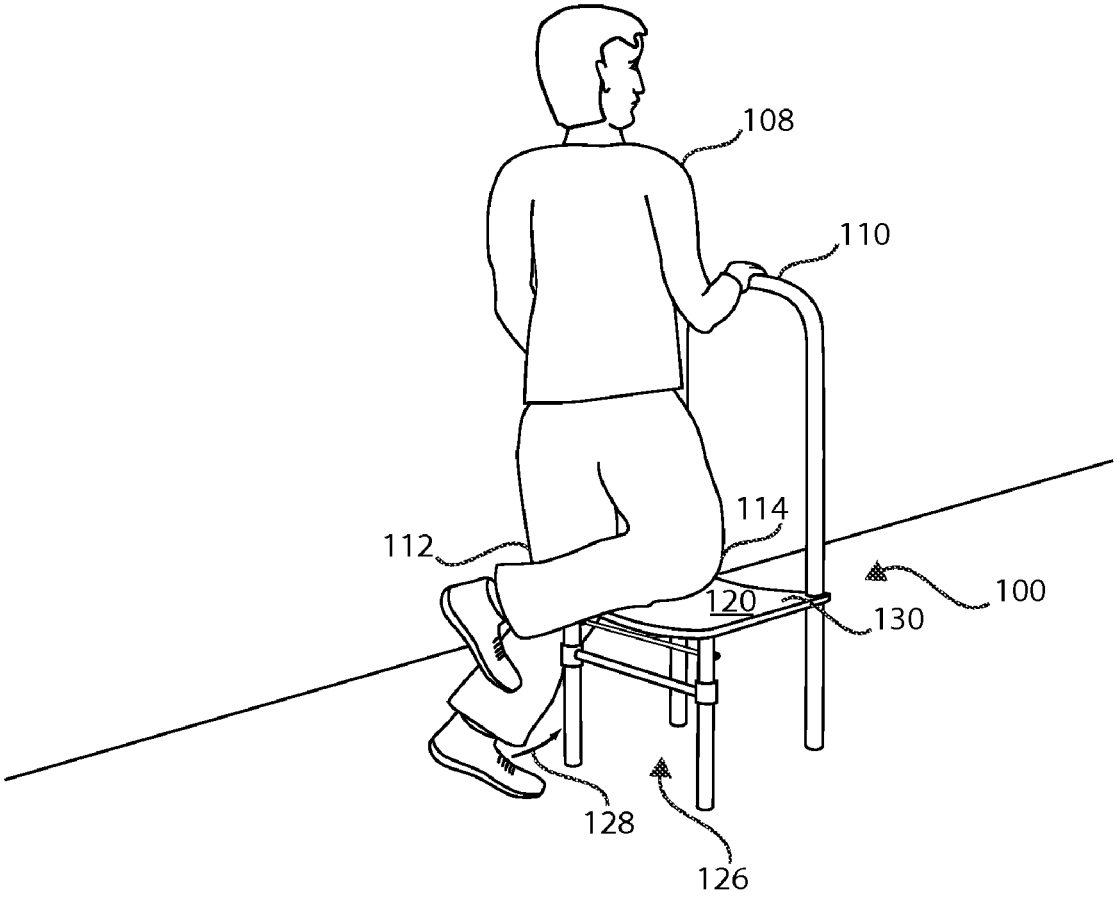
FIG. 1B is an oblique angle view of the preferred embodiment of FIG. 1A, showing the bent knee of one leg supported by the knee support platform while the user takes a step with the good leg, from the first position to a second position.

FIG. 1B is an oblique angle view of the preferred embodiment of FIG. 1A, showing the bent knee 114 of one leg supported by the knee support platform 120 while the user 108 takes a step with the good leg 112, from the first position 106 (see FIG. 1A) to a second position 126. As shown in FIG. 1B, the user 108 continues to grip the handle 110 of the device 100, while the bent knee 114 bears the entire weight of the user.

Because the knee support platform 120 supports the knee 114, which supports the weight of the user 108 at this point in the sequence, the user can move the good leg 112 forward to take a step 128 without having to hop from the first position 106 to the second position 126. Moreover, the knee support platform 120 has a flat padded upper surface 130 to provide more comfortable support for the knee 114. In some preferred embodiments the upper surface 130 is contoured rather than flat.

Figure 1C:
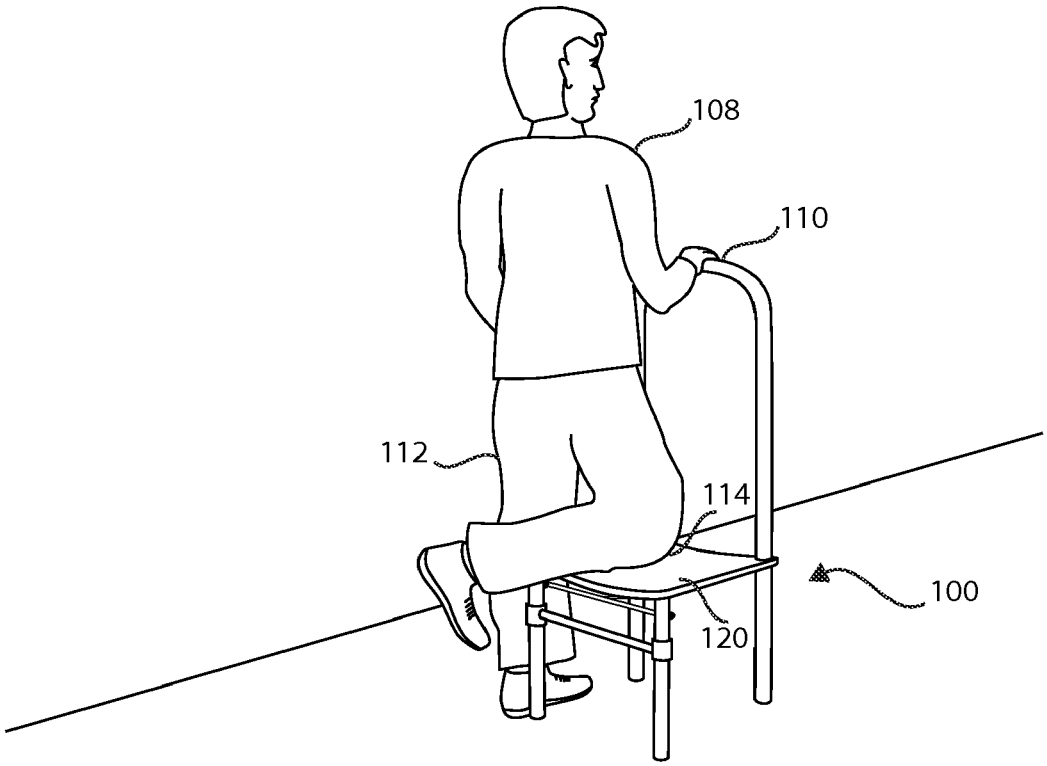
FIG. 1C is an oblique angle view of the preferred embodiment of FIG. 1A, showing the bent knee of one leg supported by the knee support platform, the user having taken the step with the other leg, from the first position to the second position.

FIG. 1C is an oblique angle view of the preferred embodiment of FIG. 1A, showing the bent knee 114 of one leg supported by the knee support platform 120, the user 108 having taken the step 128 (see FIG. 1B) with the other leg 112, from the first position 106 (see FIG. 1A) to the second position 126 (see FIG. 1B). The user 108 continues to grip the handle 110 of the device 100, while both the good leg 112 and the bent knee 114 can bear the weight of the user.

Figure 1D:
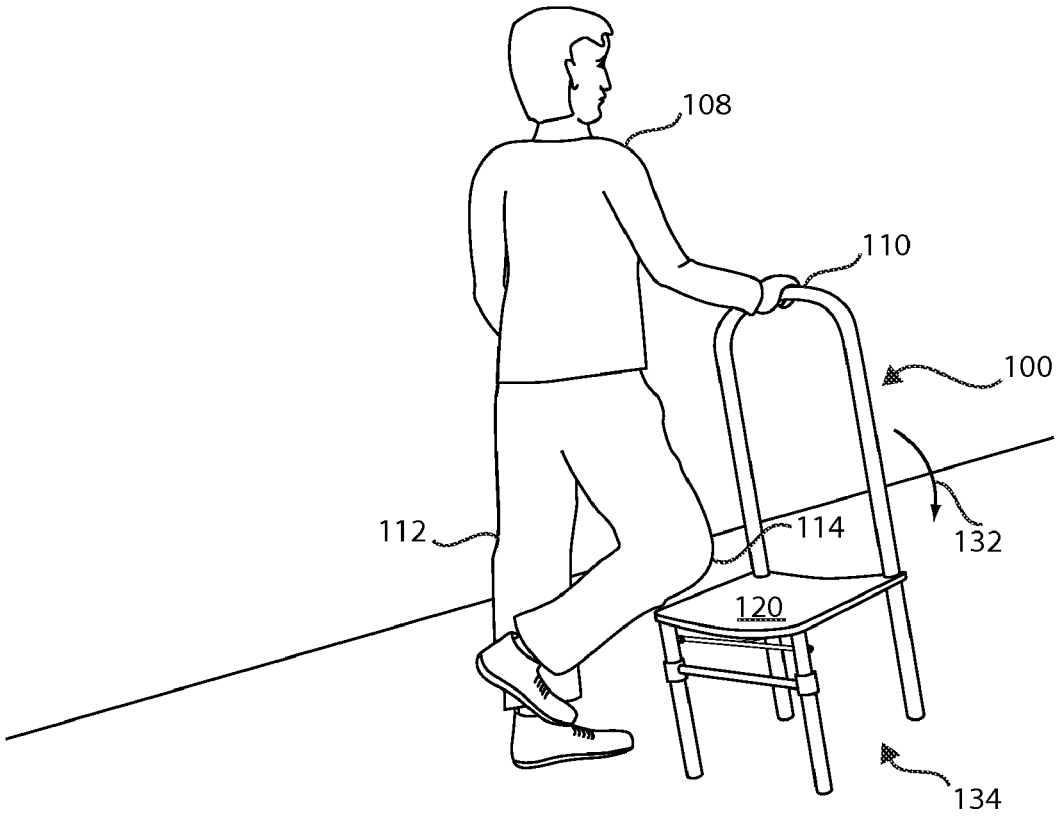
FIG. 1D is an oblique angle view of the preferred embodiment of FIG. 1A, showing the step completed, the user having removed the knee from the knee support platform and/or shifting his weight to the good leg, and moving the device to a third position about a distance of one step ahead of the second position.

FIG. 1D is an oblique angle view of the preferred embodiment of FIG. 1A, showing the step 128 (see FIG. 1B) completed, the user 108 having removed the knee 114 from the knee support platform 120 and/or shifting his weight to the good leg 112, and moving 132 the device 100 to a third position 134 about a distance of one step ahead of the second position 126 (see FIG. 1B). The user 108 of the device 100 has lifted the device with one hand on the handle 110 of the device, and is standing erect on the good leg 112 with the knee 114 of the other leg bent.

Figure 1E:
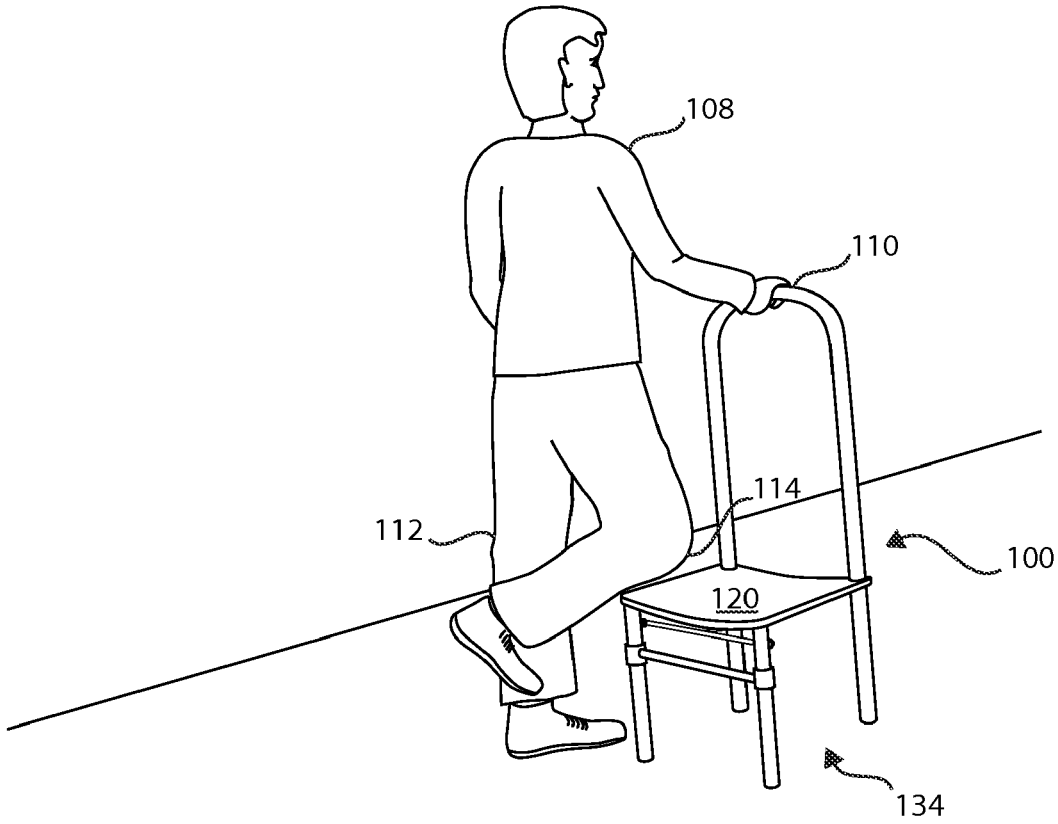
FIG. 1E is an oblique angle view of the preferred embodiment of FIG. 1A, showing the device in place in the third position and the knee of the user about to be placed on the knee support platform.

FIG. 1E is an oblique angle view of the preferred embodiment of FIG. 1A, showing the device 100 in place in the third position 134 and the knee 114 of the user 108 about to be placed on the knee support platform 120. The user 108 having taken a step is thus brought to a similar point in the sequence as is shown above in FIG. 1A. In FIG. 1E, the user 108 of the device 100 is gripping the handle 110 of the device, and continues to stand on the good leg 112 with the knee 114 of the other leg bent. The adaptable mobility aid device 100 provides stable support at this point in the sequence so that the user 108 can use the device for knee support during movement of the good leg 112.

FIG. 2A through FIG. 2E depict a sequence of steps that illustrates the use of an adaptable mobility aid device in a preferred embodiment on a stairway.

Figure 2A:
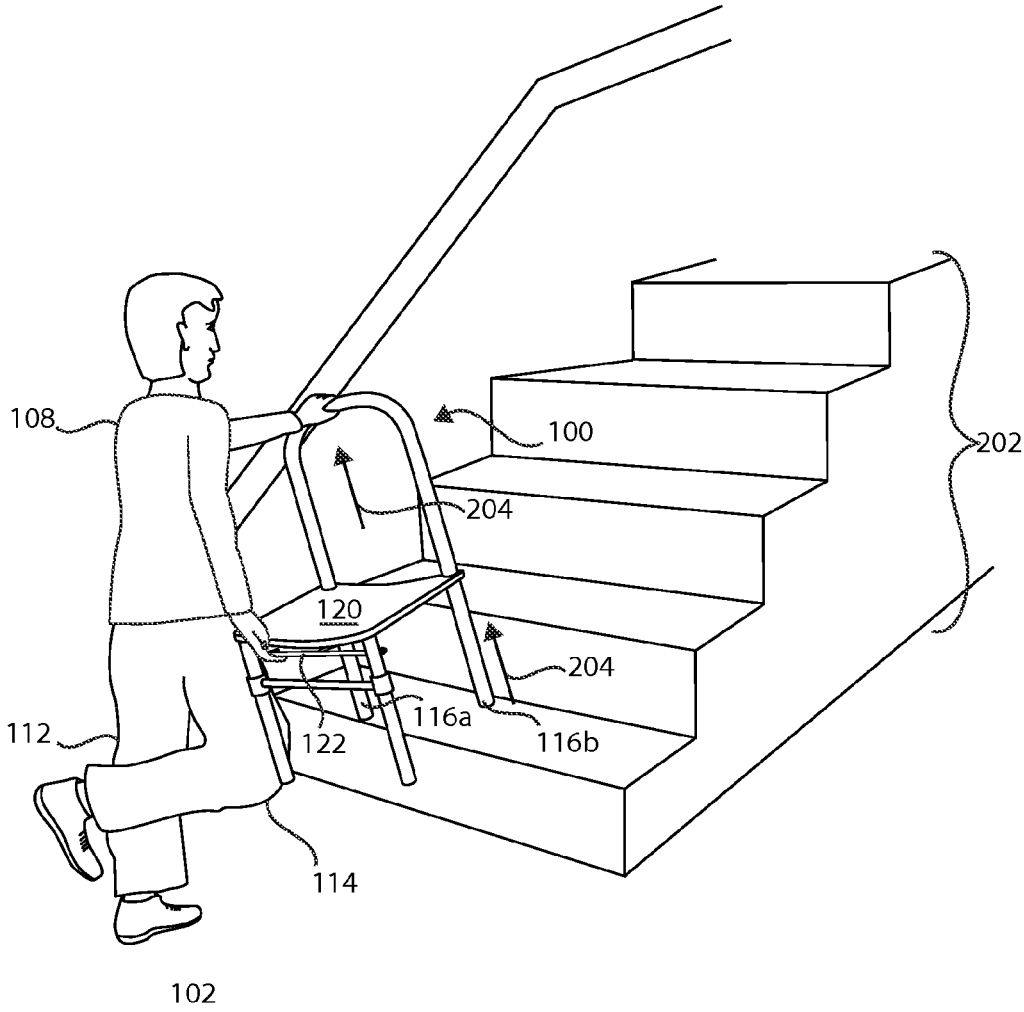
FIG. 2A is an oblique angle view of the preferred embodiment of FIG. 1A, showing the user at the bottom of a stairway, the user having removed the knee from the knee support platform and standing erect on the good leg.

FIG. 2A is an oblique angle view of the preferred embodiment of FIG. 1A, showing the user 108 at the bottom of a stairway 202, the user 108 having removed the knee 114 from the knee support platform 120 and standing erect on the good leg 112. The user 108 is operating an adjustment mechanism (402, see FIG. 4) via the spring-loaded pull bar 122 to convert the device 100 from use on the level walkway 102 to use on the stairway 202 by shortening the front legs 116*a*, 116*b* as shown by the arrow 204. The adjustment mechanism 402 is single-hand operable via a pull by the user 108 and configured to shorten or lengthen the front legs 116*a*, 116*b* in tandem. By use of the adjustment mechanism 402, the device 100 can be adjusted so that the knee support platform 120 is level and remains at a comfortable height for use by the user 108, when the device is used on stairs.

Figure 2B:
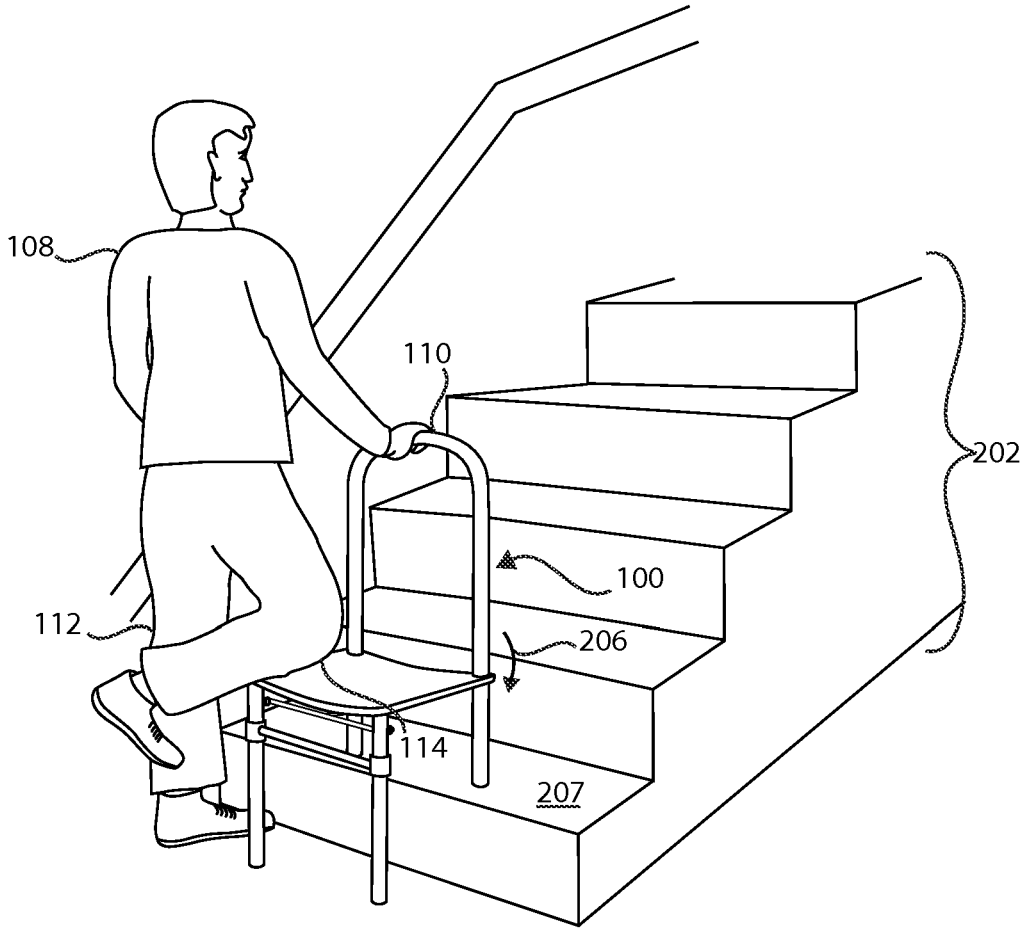
FIG. 2B is an oblique angle view of the preferred embodiment of FIG. 1A, illustrating the device in use as a adaptable mobility aid device on a stairway, and showing placement of the device on the bottom stair of the stairway.

FIG. 2B is an oblique angle view of the preferred embodiment of FIG. 1A, illustrating the device 100 in use as an adaptable mobility aid device on a stairway 202, and showing placement 206 of the device on the bottom stair 207 of the stairway. The user 108 of the device 100 has lifted the device with one hand on the handle 110 of the device, and is standing erect on the good leg 112 with the knee 114 of the other leg bent. For stairway use, the adaptable mobility aid device 100 is configured so that the front legs 116*a* and 116*b* (see FIG. 2A) engage an upper step and the rear legs 118*a* and 118*b* (see FIG. 1A) engage an adjacent lower step so as to support the knee support platform in a position over a portion of the upper step and over a portion of the adjacent lower step, and with the knee support platform disposed approximately horizontally. It will be appreciated that the device 100 is designed to straddle and span two steps for use on stairs, an aspect of the invention that will be discussed further below in connection with FIG. 2E. As used herein and in the accompanying claims, the term step refers to an upper surface of a stair step as well as a portion of a flat walkway adjacent a stairway.

Figure 2C:
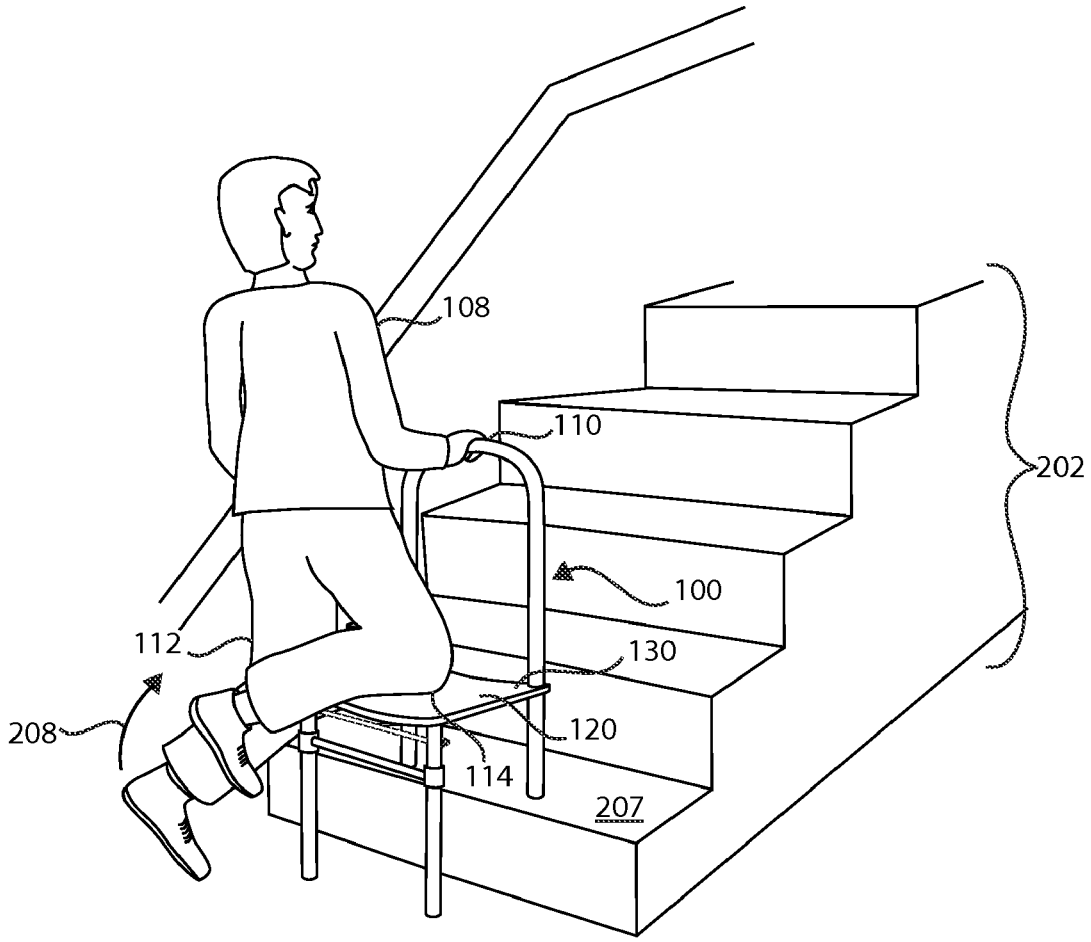
FIG. 2C is an oblique angle view of the preferred embodiment of FIG. 1A, showing the bent knee of one leg supported by the knee support platform while the user takes a step with the good leg, from the bottom of the stair to the adjacent step.

FIG. 2C is an oblique angle view of the preferred embodiment of FIG. 1A, showing the bent knee 114 of one leg supported by the knee support platform 120 while the user 108 takes 208 a step with the good leg 112, from the bottom of the stair to the adjacent step 207. The user 108 continues to grip the handle 110 of the device 100, while the bent knee 114 bears the entire weight of the user.

Because the knee support platform 120 supports the knee 114, which supports the weight of the user 108 at this point in the sequence, the user can move the good leg 112 forward and upward to advance 208 to the stair step 207 without having to hop from the lower step to the next stair step. Moreover, as mentioned previously, the knee support platform 120 has a flat padded upper surface 130 to provide more comfortable support for the knee 114.

Figure 2D:
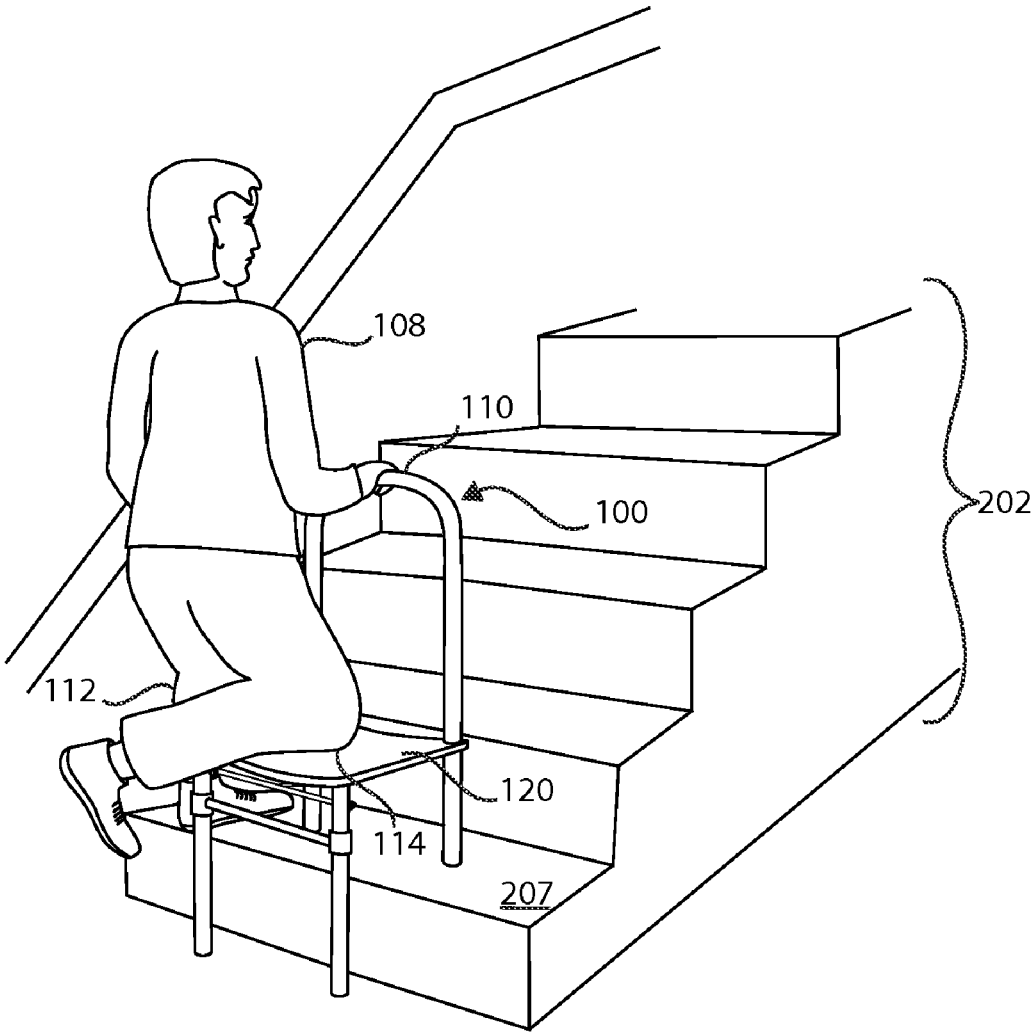
FIG. 2D is an oblique angle view of the preferred embodiment of FIG. 1A, showing the bent knee of one leg supported by the knee support platform, the user having taken the step with the good leg, from the bottom of the stairway to the bottom stair step.

FIG. 2D is an oblique angle view of the preferred embodiment of FIG. 1A, showing the bent knee 114 of one leg supported by the knee support platform 120, the user 108 having taken the step with the good leg 112, from the bottom of the stairway 202 to the bottom stair step 207. The user 108 continues to grip the handle 110 of the device 100, while both the good leg 112 and the bent knee 114 can bear the weight of the user.

Figure 2E:
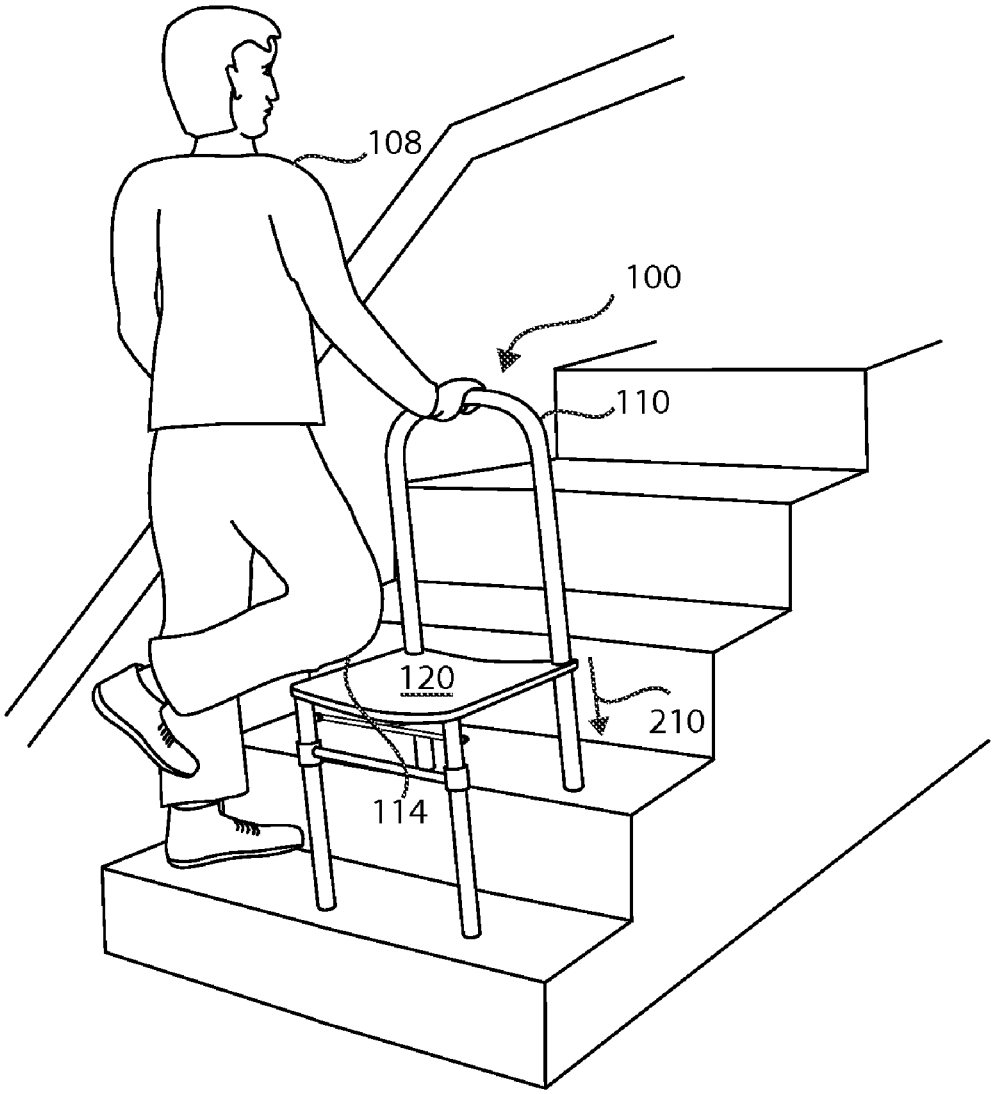
FIG. 2E is an oblique angle view of the preferred embodiment of FIG. 1A, showing the step completed, the user having removed the knee from the knee support platform and moving the device to the next stair step.

FIG. 2E is an oblique angle view of the preferred embodiment of FIG. 1A, showing the step completed, the user 108 having removed the knee 114 from the knee support platform 120 and moving 210 the device 100 to the next stair step. The user 108 of the device 100 has lifted the device with one hand on the handle 110 of the device, and is standing erect on the good leg 112 with the knee 114 of the other leg bent. It is understood that descending a step can be accomplished by a user by backing down the stairs and performing the steps shown in FIGS. 2A-2E in the reverse order.

As mentioned previously, the device 100 is designed to straddle and span two steps when used on a stairway. The capability of the device 100 to straddle two steps enhances the usability of the device on stairs, and can enhance the stability of a user employing the device, for several reasons. First, in various embodiments, the device 100 has a footprint of about 9 inches square or larger, contributing to its greater stability over currently available adaptable mobility aid devices with smaller footprints that generally rest on only a single step when used on stairs.

Second, during use on a stairway, an exemplary knee support platform is positioned so as to span two steps. Thus, while the user is taking a step, or when the user shifts his or her weight from the good leg, the weight of the user is distributed between the two steps. In this situation, a slight shift of the user's posture brings the majority of the user's weight to bear on the upper step, or on the lower step. This capability to shift the user's weight to the upper step or alternatively the lower step can make it easier for the user to mount or descend stairs.

Third, the positioning of the knee support platform over both steps results in the user's center of gravity being positioned about midway between the two steps. This is a much more natural positioning of the user's center of gravity while the user takes a step from one step to an adjacent step, whether ascending or descending. The more natural position can make it easier for the user to mount or descend stairs.

Fourth, use of the device 100 for descending stairs can better accommodate the frequently limited mobility of the user. The stairway descent is safer in that a user descends the stairs by lowering the good leg 112 first, then the device 100 is transported to the lower step with the weight of the user supported by the good leg. In contrast, when descending stairs using an adaptable mobility aid device that doesn't straddle two steps but instead rests on only a single step, typically a user is obliged to lower the device, and the injured leg, first. The knee of the good leg must be bent during this transition from one step to the lower step, while at the same time, the weight of the user must be borne by the good leg. Then, after the device and injured leg are positioned on the next lower step, a step to the lower step is taken with the good leg. The user may be put in an awkward and unstable position during part of this sequence. Furthermore, this mode of descent can be problematic for uncoordinated and/or elderly individuals.

Thus, by its design for straddling stairs, the device 100 fosters use of a more natural gait by the user during ascent and descent of stairs. Moreover, adjustment of the front legs of the device 100 to afford the stability just discussed can be done in seconds without tools, using a single hand to operate the adjustment mechanism.

In many cases, an individual recovering from lower leg surgery or a leg injury can become fatigued by the effort of climbing or descending a staircase. Such individuals may wish to sit for a short time to gain a respite from the effort of climbing or descending. Embodiments of the present invention readily provide such respite from the exertion of stair use. Use of the device 100 as a seat for resting is discussed in connection with FIGS. 3 and 3B.

Figure 3:
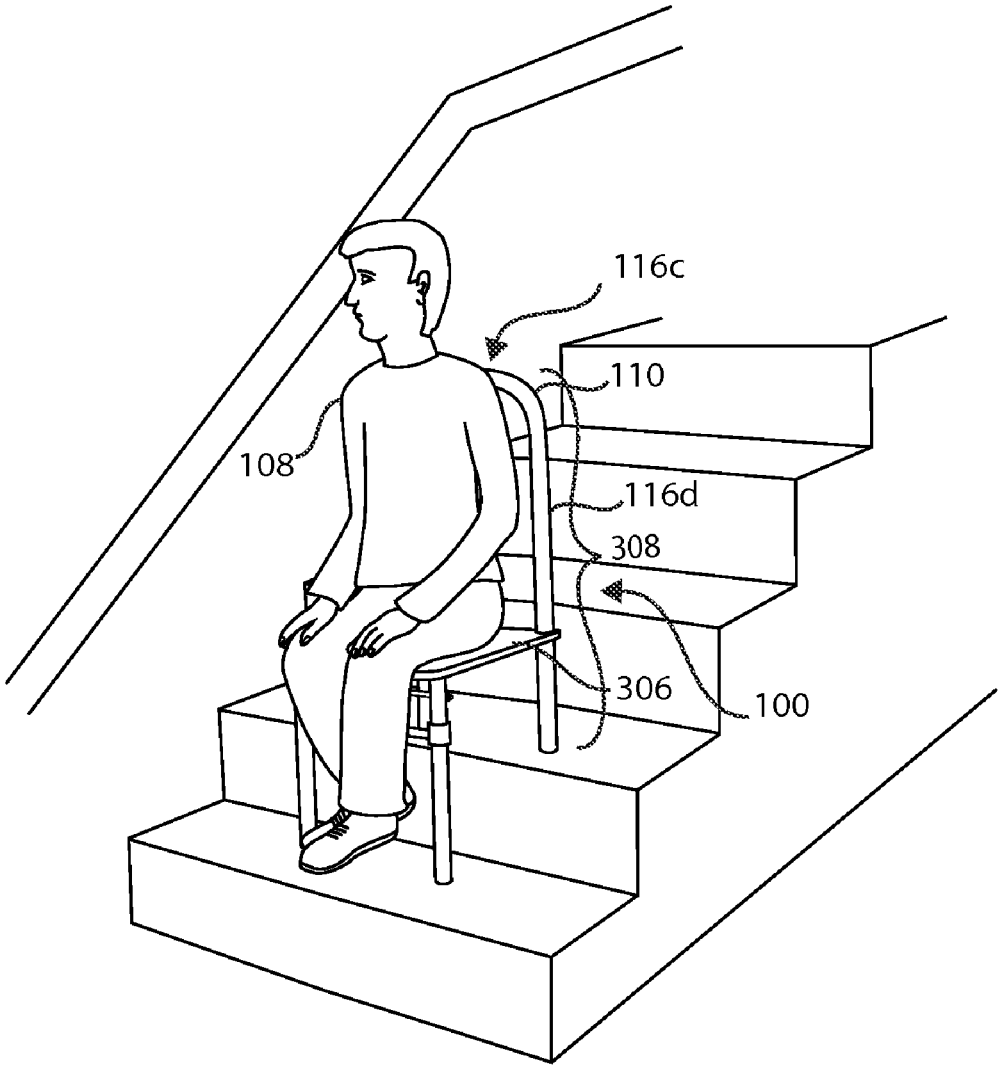
FIG. 3 is an oblique angle view of the preferred embodiment of FIG. 1A, showing use of the knee support platform as a seat for resting during climbing or descending stairs.

FIG. 3 is an oblique angle view of the preferred embodiment of FIG. 1A, showing use of the knee support platform 120 (see FIG. 1A) as a seat 306 for resting during climbing or descending stairs. The handle 110 of the device 100, along with the leg extensions 116*c* and 116*d*, which act as upright supports for the handle, form a back support frame 308 when the knee support platform 120 is in use as a seat 306. In this manner a user 108 of the adaptable mobility aid device 100 can recover to some extent from fatigue due to stair climbing or descending.

Figure 3A:
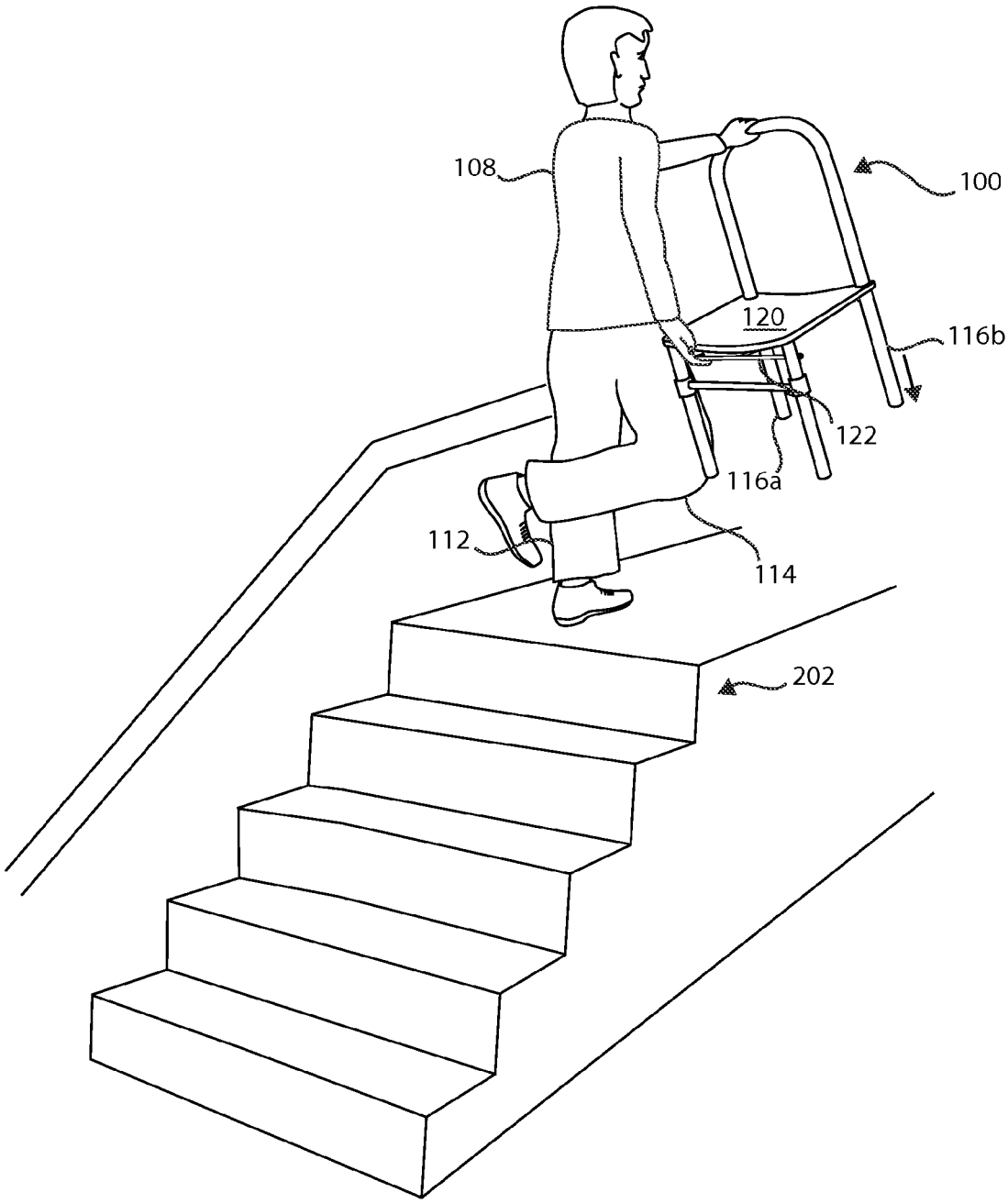
FIG. 3A is an oblique angle view of the preferred embodiment of FIG. 1A, showing the user at the top of the stairway, the user having removed the knee from the knee support platform and standing erect on the good leg.

FIG. 3A is an oblique angle view of the preferred embodiment of FIG. 1A, showing the user 108 at the top of the stairway 202, the user having removed the knee 114 from the knee support platform 120 and standing erect on the good leg 112. The user 108 is operating the adjustment mechanism 402 (see FIG. 4) to convert the device 100 from use on the stairway to use on a flat walkway by lengthening the front legs 116*a* and 116*b*. As mentioned previously, the adjustment mechanism 402 is single-hand operable, and is configured to lengthen the front legs 116*a* and 116*b* in tandem. As in FIG. 1E, the adjustment mechanism is operable via a pull of the pull bar 122 by the user 108, as shown. By use of the adjustment mechanism 402, the device 100 can be adjusted so that the knee support platform 120 is level and remains at a comfortable height for use by the user 108, when the device is used on a level walkway.

In many cases, an individual recovering from lower leg surgery or a leg injury can become fatigued even by the effort of walking on a level walkway. Such individuals may wish to sit for a short time to gain a respite from the effort of walking. Embodiments of the present invention readily enable respite from the exertion of walking on a level walkway, as discussed next.

Figure 3B:
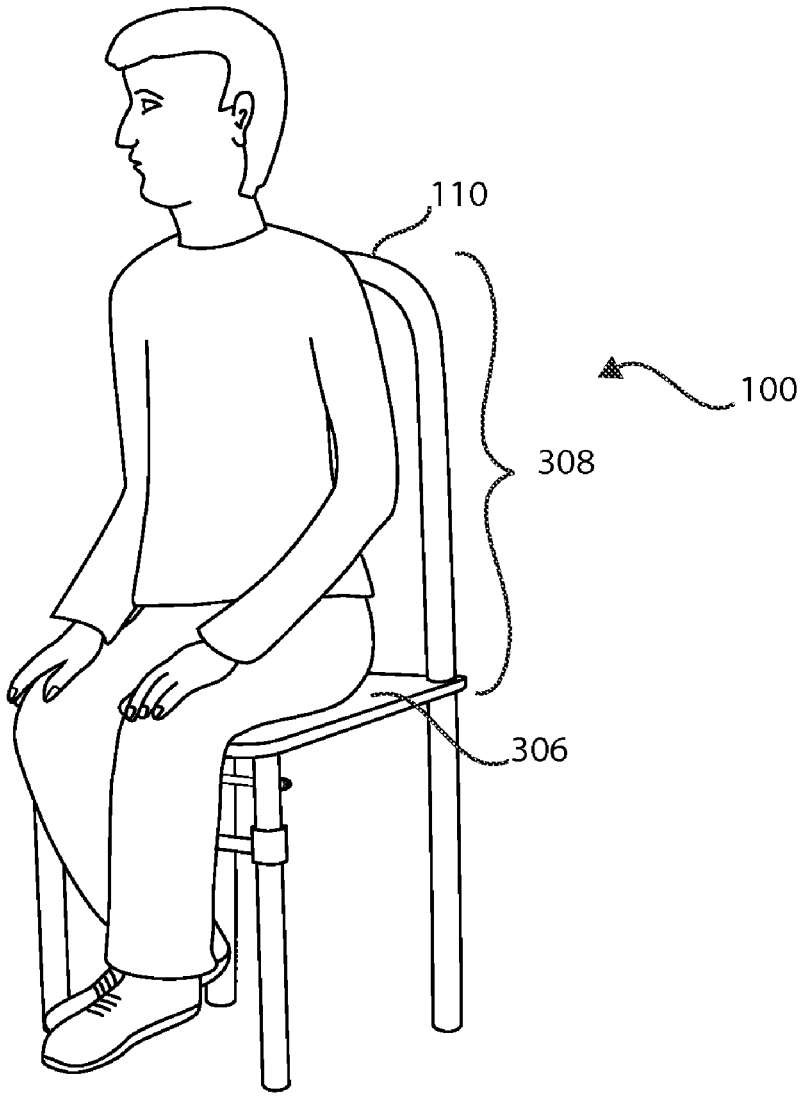
FIG. 3B is an oblique angle view of the preferred embodiment of FIG. 1A, showing use of the knee support platform as a seat for resting during use of the device on a walkway, such as the level walkway.

FIG. 3B is an oblique angle view of the preferred embodiment of FIG. 1A, showing use of the knee support platform 120 (see FIG. 1A) as a seat 306 for resting during use of the device 100 on a walkway, such as the level walkway 102 (see FIG. 1A). The handle 110 of the device 100, along with the leg extensions 116*c* and 116*d* (see FIG. 3) that form upright supports for the handle, form a back support frame 308 when the knee support platform 120 is in use as a seat 306. It will be appreciated that adjustability of the front legs enables use of the device 100 as a seat even on an inclined walkway, should a user become fatigued during use of the device on the inclined walkway.

Figure 4:
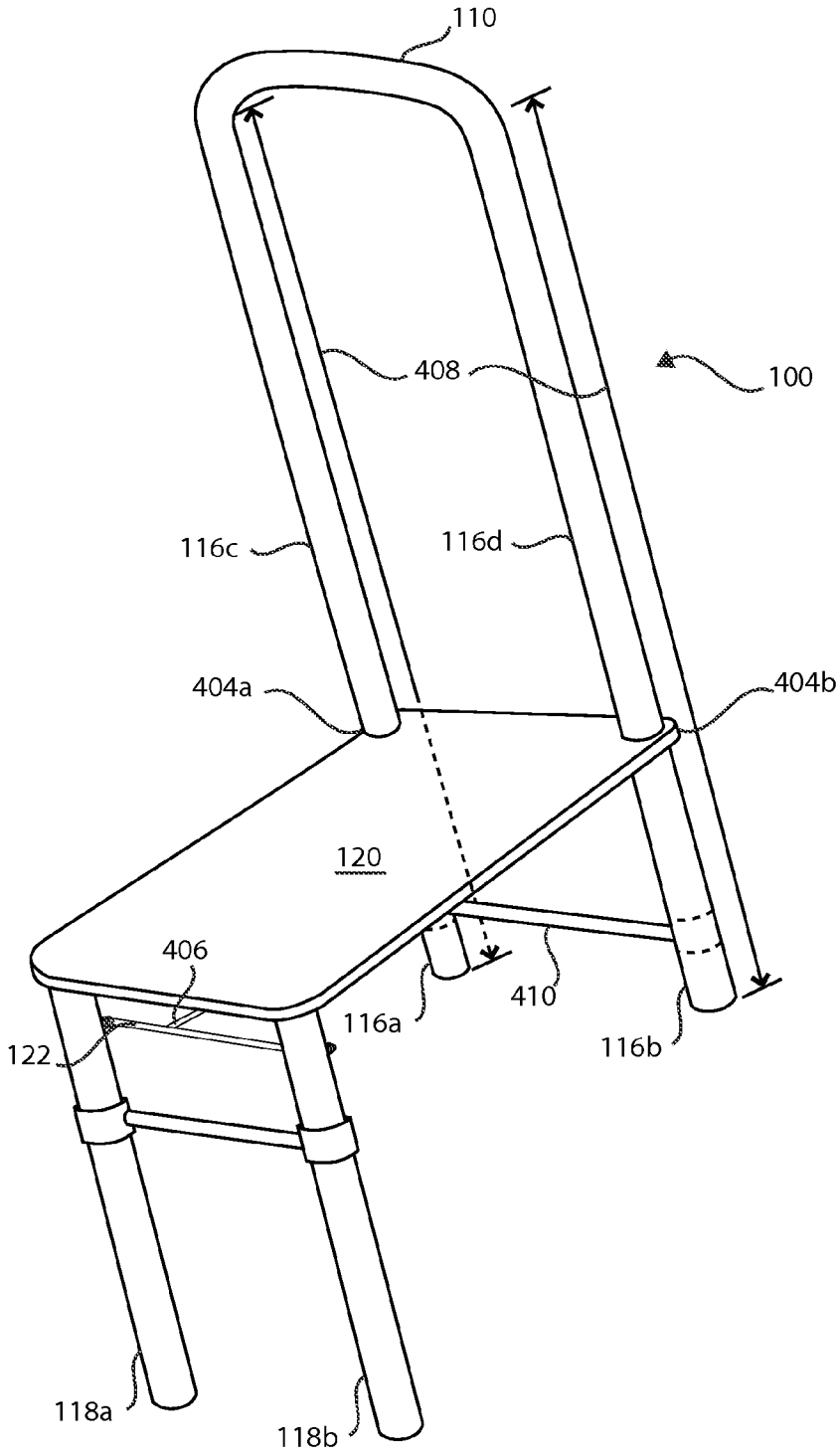
FIG. 4 is an oblique angle view of the embodiment of FIG. 1A, showing the adaptable mobility aid device by itself to better portray the adjustment mechanism by which the length of the front legs can be adjusted.

FIG. 4 is an oblique angle view of the embodiment of FIG. 1A, showing the adaptable mobility aid device 100 by itself to better portray the adjustment mechanism 402 by which the length of the front legs 116*a* and 116*b* can be adjusted. As shown in FIG. 4, the adjustment mechanism 402 includes two sleeves 404*a* and 404*b* coupled to the knee support platform 120. The legs 116*a* and 116*b* are coupled with the handle 110 through leg extensions 116*c* and 116*d*. In the preferred embodiment of FIG. 1A, the legs 116*a* and 116*b*, and the leg extensions 116*c* and 116*d*, have the same diameter, and are configured to nest within the sleeves 404*a* and 404*b*. Ordinarily, the legs and leg extensions 116*a* through 116*d* are locked in position until the adjustment mechanism 402 is activated. It is understood that leg adjustability can be enabled in other ways, for example, each leg may be configured as a rail sliding inside a groove or larger rail, and nesting need not mean only complete surrounding by the sleeve, but alternatively may encompass the interlocking of sliding rails as just described.

The adjustment mechanism 402 is activated when a pull on the pull bar 122 is communicated to the adjustment mechanism 402 by the linkage 406. The spring-loading of the pull bar 122 may be accomplished through the linkage 406 of the pull bar with, for example, spring-loaded pins (see FIG. 4A). When the adjustment mechanism is activated, the legs 116*a* and 116*b* can be lengthened or shortened together by a push down or pull up on the handle 110. That is, the leg 116*a* and the leg extension 116*c* have a fixed combined length 408. Similarly, the leg 116*b* and the leg extension 116*d* have the same fixed combined length 408. Thus, a push down on the handle 110 when the adjustment mechanism 402 is activated increases the length of the legs 116*a* and 116*b* below the knee support platform 120, while decreasing the lengths of the leg extensions 116*c* and 116*d* above the knee support platform. Conversely, a pull up on the handle 110 when the adjustment mechanism 402 is activated decreases the length of the legs 116*a* and 116*b* below the knee support platform 120, while increasing the lengths of the leg extensions 116*c* and 116*d* above the knee support platform.

It will be appreciated that other adjustment mechanisms having adjustable couplings can be adapted for use on an adaptable mobility aid device 100 by skilled artisans without undue experimentation. An adaptable mobility aid device that incorporates any such adjustment mechanism and/or adjustable coupling, and that embodies the inventive concepts described herein of straddling two adjacent steps during stairway use, is within the scope of the present disclosure. Preferred embodiments of the present invent that include alternative adjustment mechanisms and/or adjustable couplings are described in detail below.

In some alternative embodiments, the actuator for the adjustment mechanism may be positioned close to the front legs 116*a* and 116*b*, rather than close to the rear legs 118*a* and 118*b* as shown by the pull bar 122 and linkage 406. These details are discussed further in connection with FIG. 4A. Also, in some of these alternative embodiments, the legs 116*a* and 116*b* have a smaller diameter than the leg extensions 116*c* and 116*d*, and are configured to nest within the leg extensions, as well as nesting within the sleeves 404*a* and 404*b*. A crosspiece or crossbar 410 enables sliding of the legs 116*a* and 116*b* in tandem when the adjustment mechanism 402 is activated.

Figure 4A:
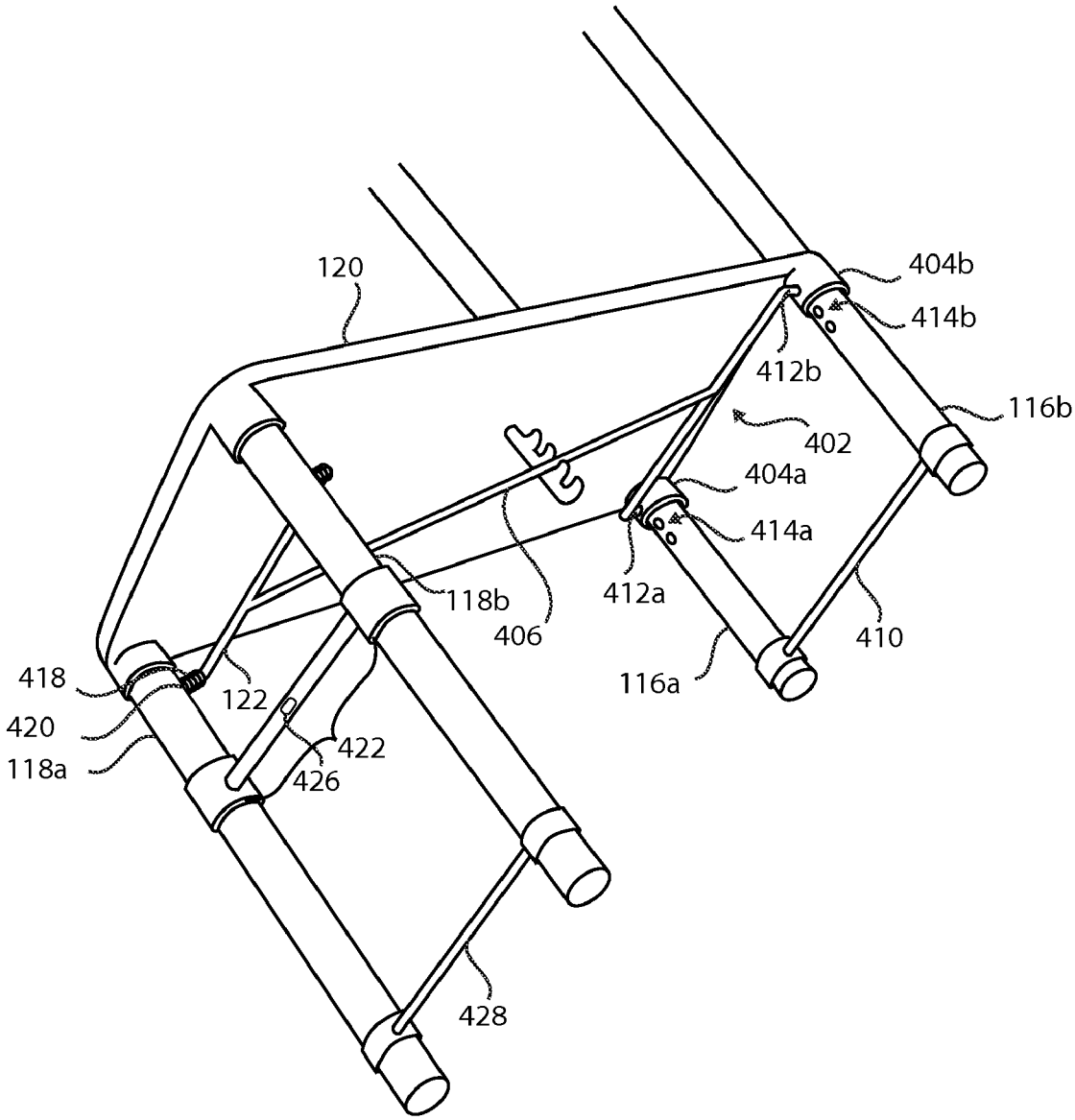
FIG. 4A is an oblique bottom view of the preferred embodiment of FIG. 1A, showing in more detail the front adjustment mechanism.

FIG. 4A is an oblique bottom view of the preferred embodiment of FIG. 1A, showing in more detail the front adjustment mechanism 402. The adjustment mechanism 402 includes a pair of sleeves 404*a* and 404*b* coupled to the knee support platform 120, each sleeve receiving a corresponding front leg 116*a* and 116*b*, respectively, for sliding motion unless the motion is restrained by a pin, for example, the pins 412*a* and 412*b*. Each of the pins 412*a* and 412*b* restrains sliding motion by interlocking with one of a series 414*a* or 414*b* of apertures in its corresponding leg 116*a* or 116*b*. The pins 412*a* and 412*b* are operated together for disengagement from their corresponding apertures by actuation of a spring-loaded bar 122. Moreover, various preferred embodiments can include a front crossbar or crosspiece 410 by which the front legs can be moved together in tandem. The bar 122 may be spring-loaded via one or more springs 418 positioned in, for example, slots or recesses 420 within the rear legs 118*a* and/or 118*b*.

Figure 4B:
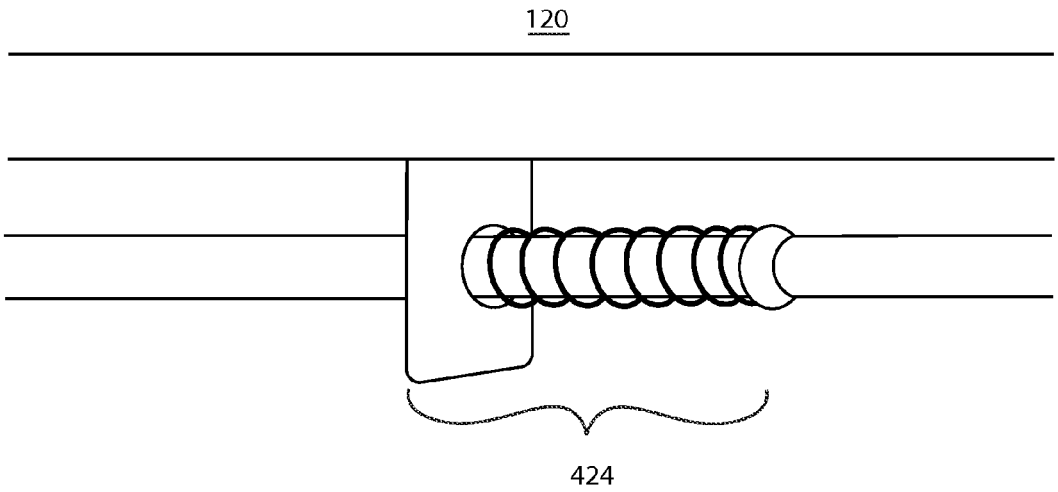
FIG. 4B is an oblique angle view of an embodiment showing a portion of a pull bar spring-loaded via a spring-and-flange arrangement.

FIG. 4B is an oblique angle view of an embodiment showing a portion of a pull bar spring-loaded via a spring-and-flange arrangement. In embodiment of FIG. 4B, the pull bar 122 or linkage 406 (see FIG. 4A) may be spring-loaded via one or more spring-and-flange arrangements 424 through which the sides of the pull bar traverse under the knee support platform 120, guiding the bar and keeping it tensioned. In some other embodiments, the pins 412*a* and 412*b* themselves can be spring-loaded, for example, by springs within the sleeves 404*a* and 404*b*, with the spring-loading of the pins providing corresponding spring-loading of the pull bar 122 via the linkage 406.

Resuming the discussion of FIG. 4A, it also shows a rear adjustment mechanism 422, that is single-hand operable, for example, via a push button 426. In preferred embodiments the rear legs 118*a* and 118*b* are connected by a rear crossbar 428 to enable tandem motion of the rear legs to adjust their length. Details of the rear adjustment mechanism are discussed below in connection with FIG. 7.

Figure 5:
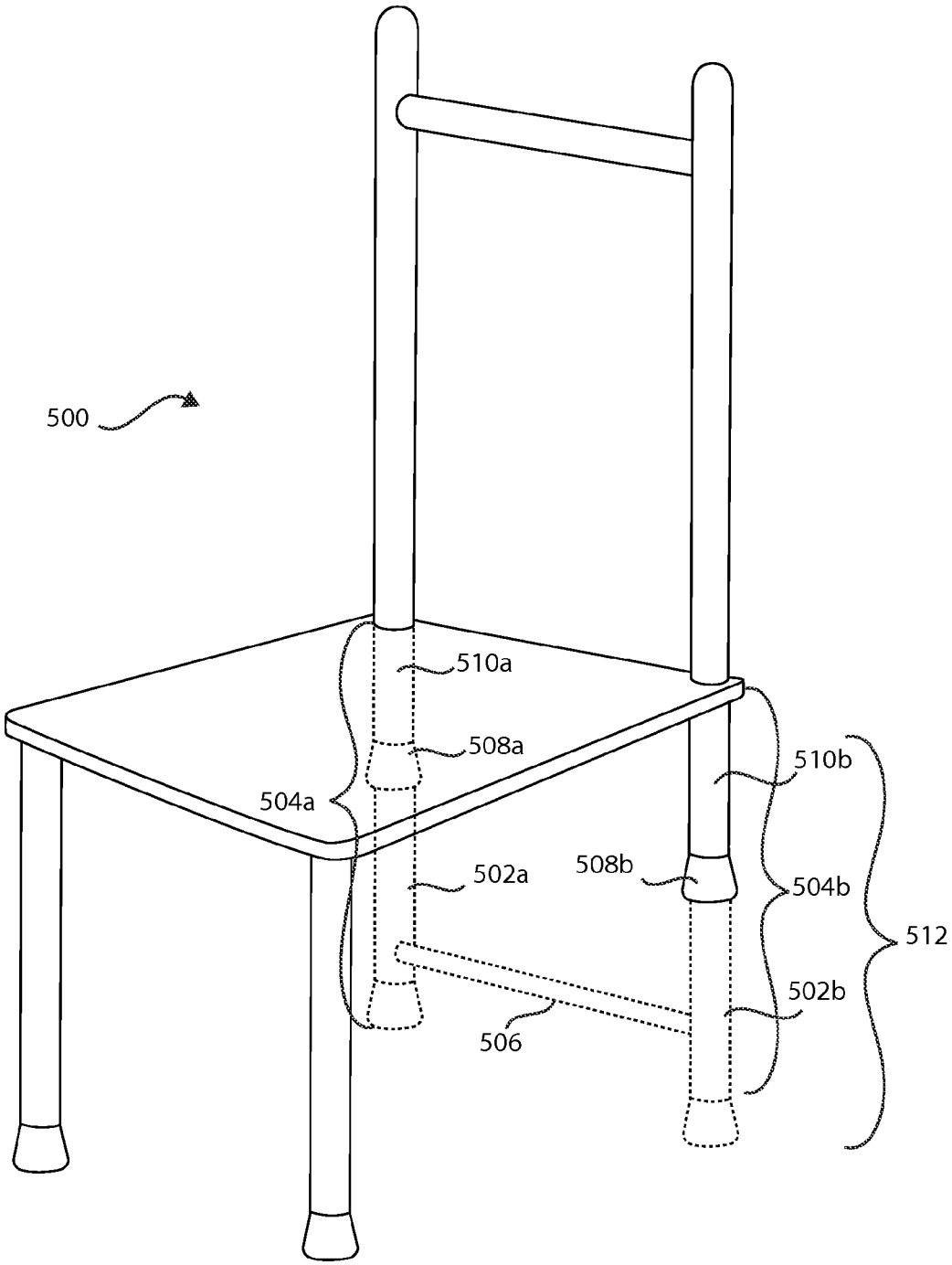
FIG. 5 is an oblique angle view of a preferred embodiment of the present invention, showing manual attachability and detachability of lower portions of the front legs of a adaptable mobility aid device to enable convertibility between use on a level walkway and use on a stairway.

In some preferred embodiments of the present invention, the front legs may be attachable and detachable manually, for example, by using a cross bar to manipulate lower, detachable portions of the legs in tandem. FIG. 5 is an oblique angle view of a preferred embodiment of the present invention, showing attachability and detachability of lower portions 502*a* and 502*b* of the front legs 504*a* and 504*b* of an adaptable mobility aid device 500 to enable convertibility between use on a level walkway 102 (see FIG. 1A) and use on a stairway 202 (see FIG. 2A). In FIG. 5, the lower portions 502*a* and 502*b* of the front legs 504*a* and 504*b* are joined with a cross bar 506 to form an H-shaped structure, so that the lower portions of the front legs may be removed from corresponding sleeves 508*a* and 508*b* in the upper portions 510*a* and 510*b* of the front legs by pulling on the cross bar, thus shortening the front legs for use on stairs. Conversely, the legs can be lengthened by reversing the process to restore the lower portions 502*a* and 502*b* of the front legs 504*a* and 504*b* to nest in the sleeves 508*a* and 508*b*, so that the front legs 504*a* and 504*b* are of a length suitable for use on a level walkway. In this way the cross bar 506, sleeves 508*a* and 508*b*, and nesting lower portions 502*a* and 502*b* together comprise an adjustable coupling 512 that is single-hand operable to adjust the length of the front legs 504*a* and 504*b*.

Figure 6:
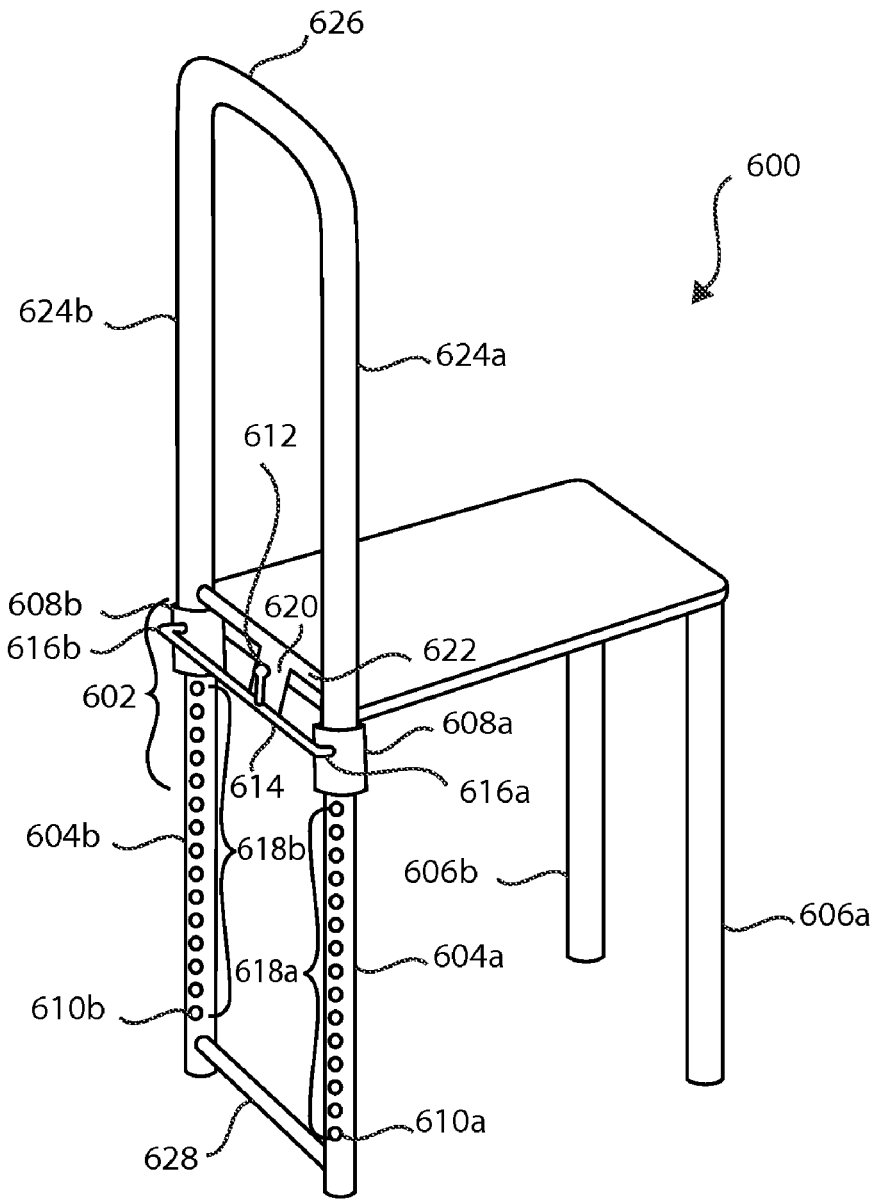
FIG. 6 is an oblique angle view of a preferred embodiment of the present invention, showing an adjustable coupling configured to be single-hand operable, and showing the adaptable mobility aid device as having two front legs, and two rear legs.

FIG. 6 is an oblique angle view of a preferred embodiment of the present invention, showing an adjustable coupling 602 configured to be single-hand operable, and showing the adaptable mobility aid device 600 as having two front legs 604*a* and 604*b*, and two rear legs 606*a* and 606*b*. Each of the front legs 604*a* and 604*b* includes a corresponding nesting portion 610*a* and 610*b*, and a corresponding sleeve portion 608*a* and 608*b* coupled to the nesting portion via the adjustable coupling 602. It is understood that the rear legs 606*a* and 606*b* may in addition have an adjustable coupling configured to be single-hand adjustable, so that the rear legs are length-adjustable as well (see, for example, FIG. 7).

As shown in FIG. 6, the adjustment mechanism includes a spring-loaded tab 612 on a connecting rod 614 that couples with two pins 616*a* and 616*b*. The spring loading is such that each pin 616*a* and 616*b* is normally urged into an aperture on the series 618*a* and 618*b* of apertures, if an aperture is available for engagement with the pin. The tab 612 can be pivoted on for example, a mounting protrusion or tongue 620 attached to a frame that supports the knee support platform 120 (see FIG. 1A), or to a horizontal support bar 622 fastened at each end to upright supports 624*a* and 624*b*. Pressing the tab 612 against the spring loading disengages the pins 616*a* and 616*b* from their respective apertures so that the front legs 604*a* and 604*b* can be shortened or lengthened as desired by sliding the front legs into or out of the upright supports 624*a* and 624*b* for the handle 626. Furthermore, in various embodiments a cross-bar 628 connects the front legs 604*a* and 604*b* to enable sliding motion of the front legs in tandem.

In some other embodiments, the adjustment mechanism includes only a single sleeve and corresponding pin, that couple with a central shaft connected to the two front legs 604*a* and 604*b*. The central shaft includes a series of apertures that can mate with the pin to normally restrain motion of the central shaft. Activating the adjustment mechanism via a spring loaded tab enables motion of the central shaft within its sleeve, and thereby enables motion of the legs 604*a* and 604*b* within the upright supports 624*a* and 624*b*.

Figure 7:
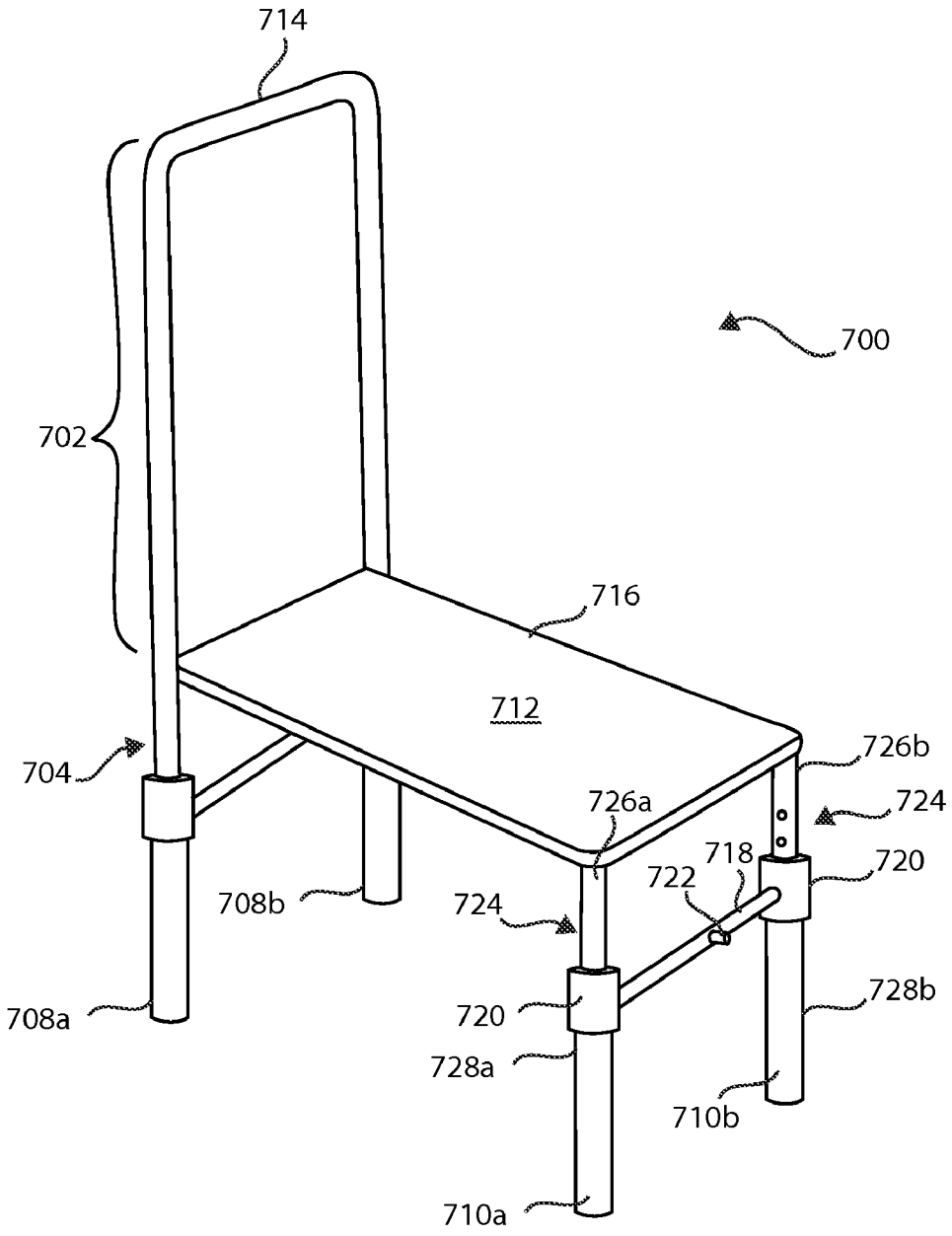
FIG. 7 is an oblique angle view of a preferred embodiment of the present invention, showing an adaptable mobility aid device with a back support frame, and showing a portion of a front adjustment mechanism, and showing a rear adjustment mechanism.

FIG. 7 is an oblique angle view of a preferred embodiment of the present invention, showing an adaptable mobility aid device 700 with a back support frame 702, and showing a portion of a front adjustment mechanism 704, and showing a rear adjustment mechanism 706. Each of the adjustment mechanisms 704 and 706 is configured for single-hand operability and configured to enable length adjustment of two legs alone or in tandem, that is front legs 708*a* and 708*b* alone or in tandem, and rear legs 710*a* and 710*b* alone or in tandem. The front legs 708*a* and 708*b* are capable of adjustment to a first length for use on stairs, and to a second length for use on a level walkway. In the preferred embodiment of FIG. 7, the device 700 also includes a knee support platform 712 coupled to the pair of front legs 708*a* and 708*b*, coupled to the pair of rear legs 710*a* and 710*b*, and coupled to the back support frame 702. In addition, the device 700 includes a handle 714 coupled to the back support frame 702. The knee support platform 712 has a flat upper surface 716, and is also adapted for use as a seat (306, see FIG. 3). As shown, the handle 714 is positioned so that it is on an opposite side of the knee support platform 712 as a user when the device 700 is in use for walking or climbing (see, for example, FIGS. 1A-1E and FIGS. 2B-2E).

The rear adjustment mechanism 706 includes a cylindrical shell 718 that connects two sleeves 720. The shell 718 also contains spring loaded shafts (not shown) coupled to pins disposed within the sleeves 720. A push button 722 protrudes from the center of the shell 718, and is coupled to the spring loaded shafts so that a push of the push button results in withdrawal of each pin from one of a series of apertures 724 in the upper portions 726*a* and 726*b* of the legs. The upper portions 726*a* and 726*b* of the legs 710*a* and 710*b* are received within the sleeves 720 and nest within the lower portions 728*a* and 728*b* of the legs. In this manner the legs 710*a* and 710*b* can be adjusted to various lengths by a push of the push button 722 and motion of the cylindrical shell 718 to slide the lower portions 728*a* and 728*b* of the legs toward or away from the knee support platform 712. The construction and operation of the front adjustment mechanism 704 is similar.

Figure 8:
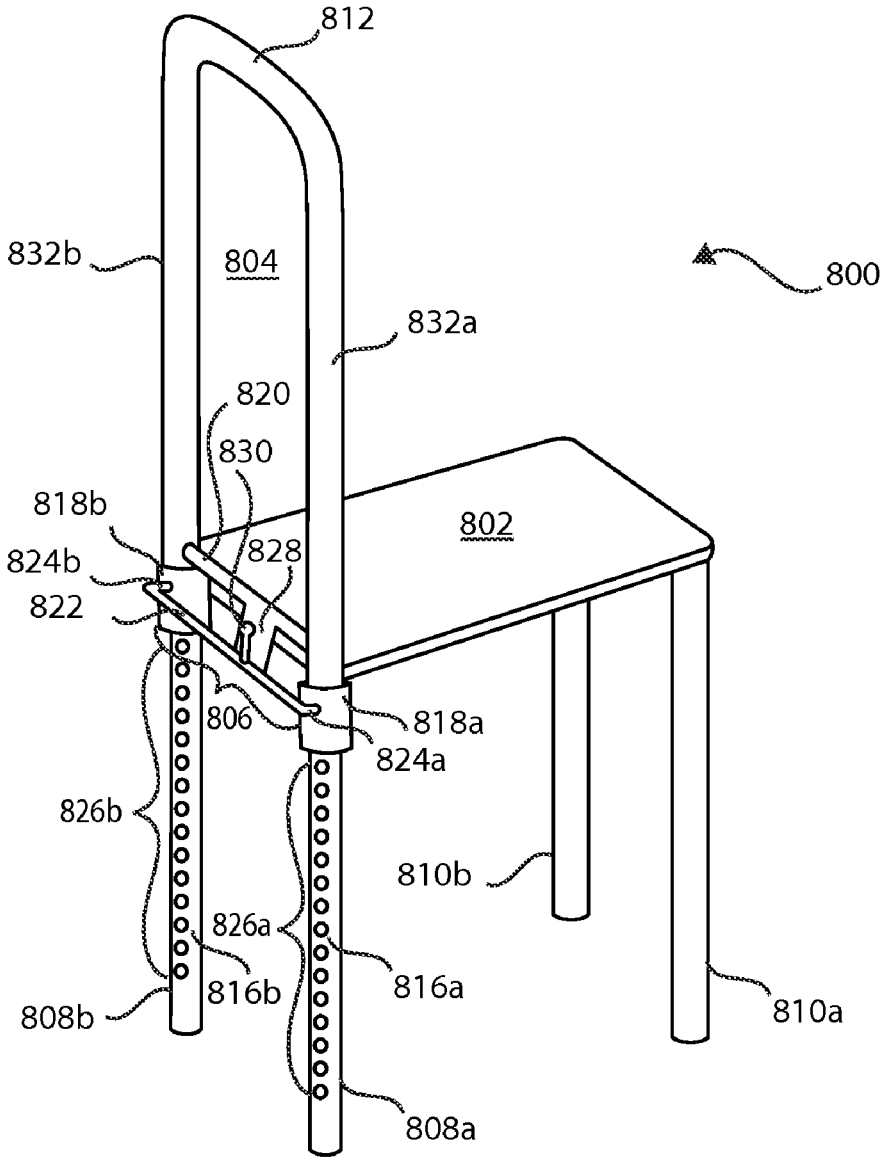
FIG. 8 is an oblique angle view of a preferred embodiment of the present invention, showing an adaptable mobility aid device that includes a seat and a back support surface with the seat also adapted for use as a knee support platform.

FIG. 8 is an oblique angle view of a preferred embodiment of the present invention, showing an adaptable mobility aid device 800 that includes a seat 802 and a back support surface 804. In addition to sitting, the seat 802 is adapted for use as a knee support platform 120 (see, for example, FIGS. 1A-1D). The embodiment of FIG. 8 also includes an adjustment mechanism 806 that can enable length adjustment in tandem of a pair of front legs 808*a* and 808*b* of the device 800, and that is single-hand operable. As with the other embodiments discussed in this disclosure, the front legs 808*a* and 808*b* are configured to engage a walking surface by frictional contact.

In addition, the front legs 808*a* and 808*b* can be adjusted to a first length for use on stairs and to a second length for use on a level walkway.

The adaptable mobility aid device 800 also includes a pair of rear legs 810*a* and 810*b* which are configured to engage a walking surface by frictional contact. The rear legs 810*a* and 810*b* can be length-adjustable in tandem via single-hand operability (see, for example, FIG. 7). In addition, the device 800 includes a handle 812 that is coupled to the back support surface 804. As shown, the handle 812 is positioned so that it is on an opposite side of seat 802 as a user when the device 800 is in use for walking or climbing where the seat is used as a knee support platform (see, for example, FIGS. 1A-1D and FIGS. 2B-2E). Also as shown in FIG. 8, the seat 802 is also coupled to the back support surface 804, as well as being coupled to the pair of front legs 808*a* and 808*b*, and to the pair of rear legs 810*a* and 810*b*. Moreover, in the preferred embodiment of FIG. 8, the handle 812 is coupled to the pair of front legs 808*a* and 808*b*, and is coupled to the back support surface 804 through the coupling of the handle to the pair of front legs.

In analogy with the embodiment shown in FIG. 6, the adjustability mechanism 806 is configured to enable length adjustment of the pair of front legs 808*a* and 808*b*, and configured for single-hand operability. Each of the front legs 808*a* and 808*b* includes a corresponding nesting portion 816*a* and 816*b*, and a corresponding sleeve portion 818*a* and 818*b* coupled to the nesting portion via the adjustable coupling 806. It is understood that the rear legs 810*a* and 810*b* may in addition have an adjustable coupling configured to be single-hand adjustable, so that the rear legs are length-adjustable as well (see, for example, FIG. 7).

As shown in FIG. 8, the adjustability mechanism 806 includes a spring-loaded tab 820 on a connecting rod 822 that couples with two pins 824*a* and 824*b*. The spring loading is such that each pin 824*a* and 824*b* is normally urged into an aperture of the series 826*a* and 826*b* of apertures, if an aperture is available for engagement with the pin. The tab 820 can be pivoted on for example, a mounting protrusion or tongue 828 attached to a frame that supports the knee support platform 802, or to a horizontal support bar 830 fastened at each end to upright supports 832*a* and 832*b* that couple the handle 812 to the front legs 808*a* and 808*b*. Pressing the tab 820 against the spring loading disengages the pins 824*a* and 824*b* from their respective apertures so that the front legs 808*a* and 808*b* can be shortened or lengthened as desired by sliding the front legs into or out of the upright supports 832*a* and 832*b* for the handle 812 and back support surface 804. Furthermore, in some embodiments a crossbar 628 (see FIG. 6) connects the front legs 808*a* and 808*b* to enable sliding motion of the front legs in tandem.

Figure 9:
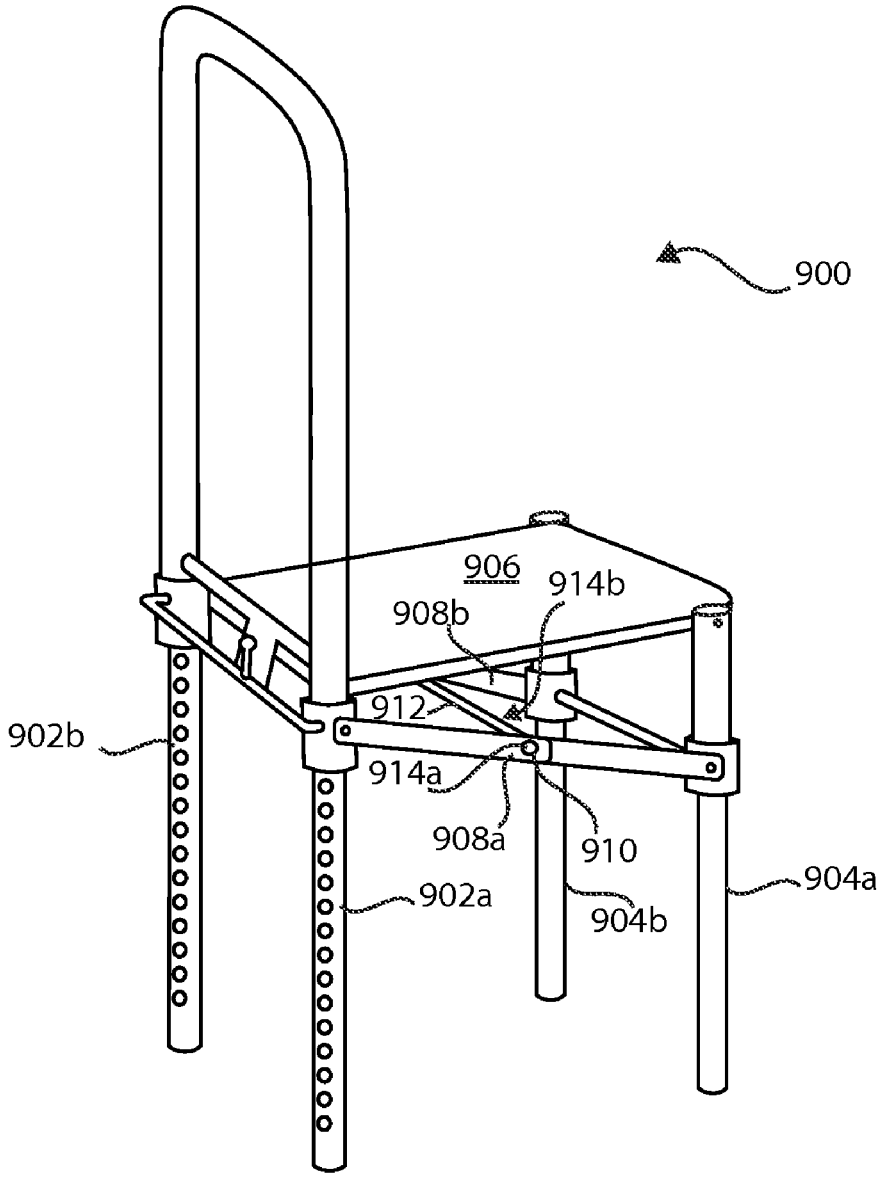
FIG. 9 is an oblique angle view of a preferred embodiment of the present invention, showing the front legs, the rear legs, and the knee support platform in cooperation to enable collapsibility of the device.

FIG. 9 is an oblique angle view of a preferred embodiment of the present invention, showing the walking aid device 900 having a pair of front legs including a left front leg 902*a* and a right front leg 902*b*, a pair of rear legs including a left rear leg 904*a* and a right rear leg 904*b*, and a knee support platform 906 in cooperation to enable collapsibility of the device. For clarity, details of the front and rear adjustment mechanisms have been omitted from FIG. 9. The knee support platform 906 can pivot with respect to the legs 902*a*, 902*b*, 904*a*, and 904*b*, and the device 900 is caused to collapse by bending of a left crossbrace 908*a* and a right crossbrace 908*b* that connect corresponding front and rear legs.

In the embodiment of FIG. 9, the left crossbrace 908*a* is pivotally attached to the left front leg 902*a* and pivotally attached to the left rear leg 904*a*. The left crossbrace 908*a* includes a pivot 910 within a central portion of the left crossbrace to enable bending of the left crossbrace. Similarly, the right crossbrace 908*b* is pivotally attached to the right front leg 902*b* and pivotally attached to the right rear leg 904*b*, the right crossbrace including a pivot (not shown) within a central portion of the right crossbrace to enable bending of the right crossbrace. A rod 912 having a left end 914*a* and a right end 914*b* is connected to the left crossbrace 908*a* at the left end 914*a* to form the pivot 910 of the left crossbrace, and connected to the right crossbrace 908*b* at the right end 914*b* to form the pivot of the right crossbrace. In this manner, a motion of the rod 912, for example, a pull downward on the rod, so as to cause bending of the left crossbrace 908*a* and the right crossbrace 908*b*, enables folding of the device 900 for storage, for example, in a closet or other storage area, or in an automobile or other vehicle. It will be appreciated that in some embodiments a folded adaptable mobility aid device 900 may also function as a cane.

Figure 9A:
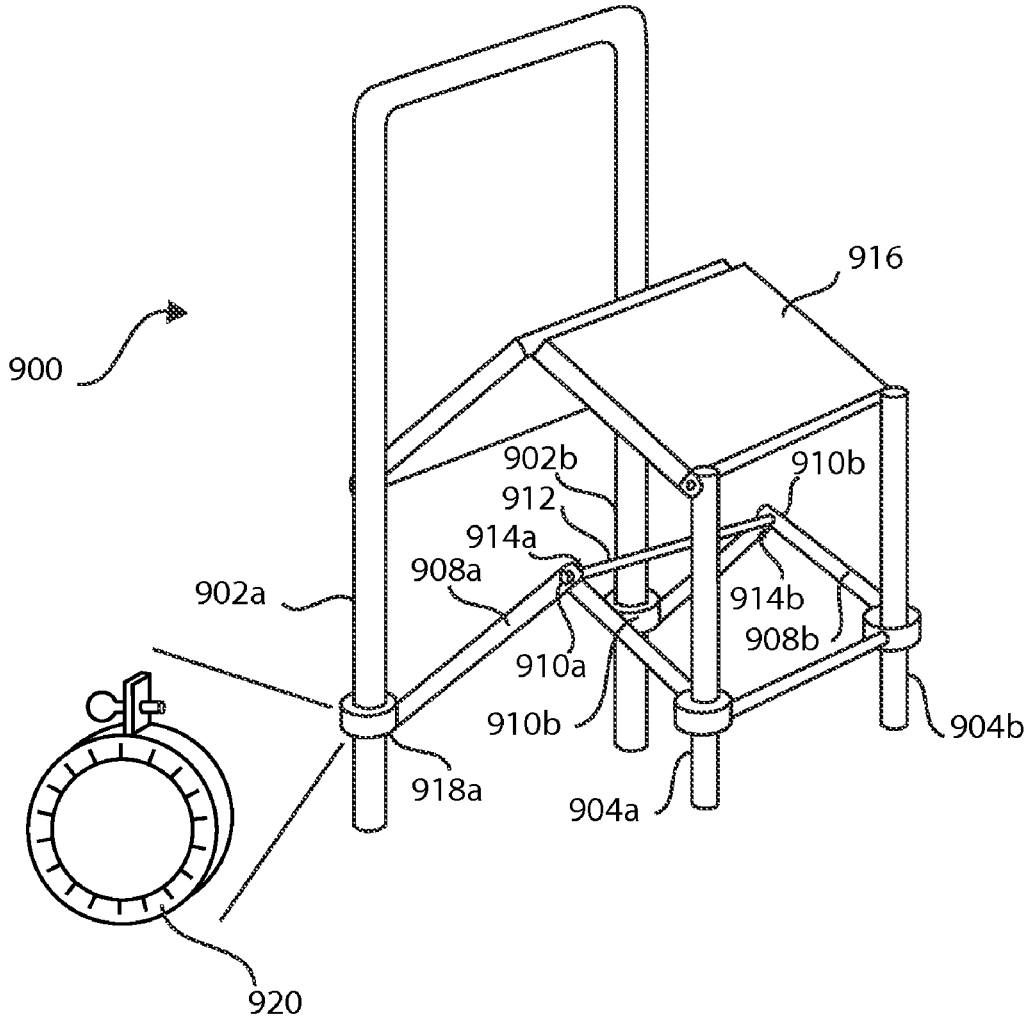
FIG. 9A is an oblique angle view of a preferred embodiment of the present invention, showing an adaptable mobility aid device having a pair of front legs including a left front leg and a right front leg, a pair of rear legs including a left rear leg and a right rear leg, and a knee support platform in cooperation to enable collapsibility of the device.

FIG. 9A is an oblique angle view of a preferred embodiment of the present invention, similar in some respects to the embodiment of FIG. 9, showing a adaptable mobility aid device 900' having a pair of front legs including a left front leg 902*a* and a right front leg 902*b*, a pair of rear legs including a left rear leg 904*a* and a right rear leg 904*b*, and a knee support platform 916 in cooperation to enable collapsibility of the device. For clarity, details of the front and rear adjustment mechanisms have been omitted from FIG. 9A. The knee support platform 916 can pivot with respect to the legs 902*a*, 902*b*, 904*a*, and 904*b*. The knee support platform 916 differs from knee support platform 906 of the embodiment of FIG. 9 in that the knee support platform 916 is foldable, as shown. The device 900' is caused to collapse by bending of a left crossbrace 908*a* and a right crossbrace 908*b* that connect corresponding front and rear legs. By being foldable, the knee support platform 916 can work together with floating clamps 918*a* and 918*b* to enable collapsibility of the adaptable mobility aid device 900'.

In the embodiment of FIG. 9A (as with the embodiment of FIG. 9), the left crossbrace 908*a* is pivotally attached to the left front leg 902*a* and pivotally attached to the left rear leg 904*a*. The left crossbrace 908*a* includes a pivot 910*a* within a central portion of the left crossbrace to enable bending of the left crossbrace. Similarly, the right crossbrace 908*b* is pivotally attached to the right front leg 902*b* and pivotally attached to the right rear leg 904*b*, the right crossbrace including a pivot 910*b* within a central portion of the right crossbrace to enable bending of the right crossbrace. A rod 912 having a left end 914*a* and a right end 914*b* is connected to the left crossbrace 908*a* at the left end 914*a* to form the pivot 910*a* of the left crossbrace, and connected to the right crossbrace 908*b* at the right end 914*b* to form the pivot 910*b* of the right crossbrace.

As mentioned above, the knee support platform 916 is foldable. At the same time, the floating clamps 918*a* and 918*b* can slide along the corresponding front legs 902*a* and 902*b*, respectively, to accommodate the folding of the knee support platform 916. The floating clamps 918*a* and 918*b* may include, for example, a plastic insert 920 that reduces friction between the clamp and the leg, while providing a relatively tight fit between the clamp and the leg. In this manner, a motion of the rod 912, for example, a pull upward on the rod, so as to cause bending of the left crossbrace 908*a* and the right crossbrace 908*b* enables, folding of the device 900' for storage, for example, in a closet or other storage area, or in an automobile or other vehicle. It will be appreciated that in some embodiments a folded adaptable mobility aid device 900' may also function as a cane.

FIG. 10 is an oblique angle view of a preferred embodiment of the present invention, showing an adaptable mobility aid device 1000 having a single adjustable front leg 1002 and a single adjustable rear leg 1004. Each of the front leg 1002 and the rear leg 1004 include a broad support element 1006 and 1008, respectively, at its base to provide lateral stability to the device 1000. The front leg 1002 and the rear leg 1004 can be adjustable via any of the adjustability mechanisms previously described and suitably modified for use with a single leg rather than with legs in tandem. In this embodiment, the knee support platform 1010 is also tilted slightly upwards in the direction from the rear leg towards the front leg. This may be desirable for some users who do not wish to bend their knee at a full 90 degree angle, for example.

Figure 11:
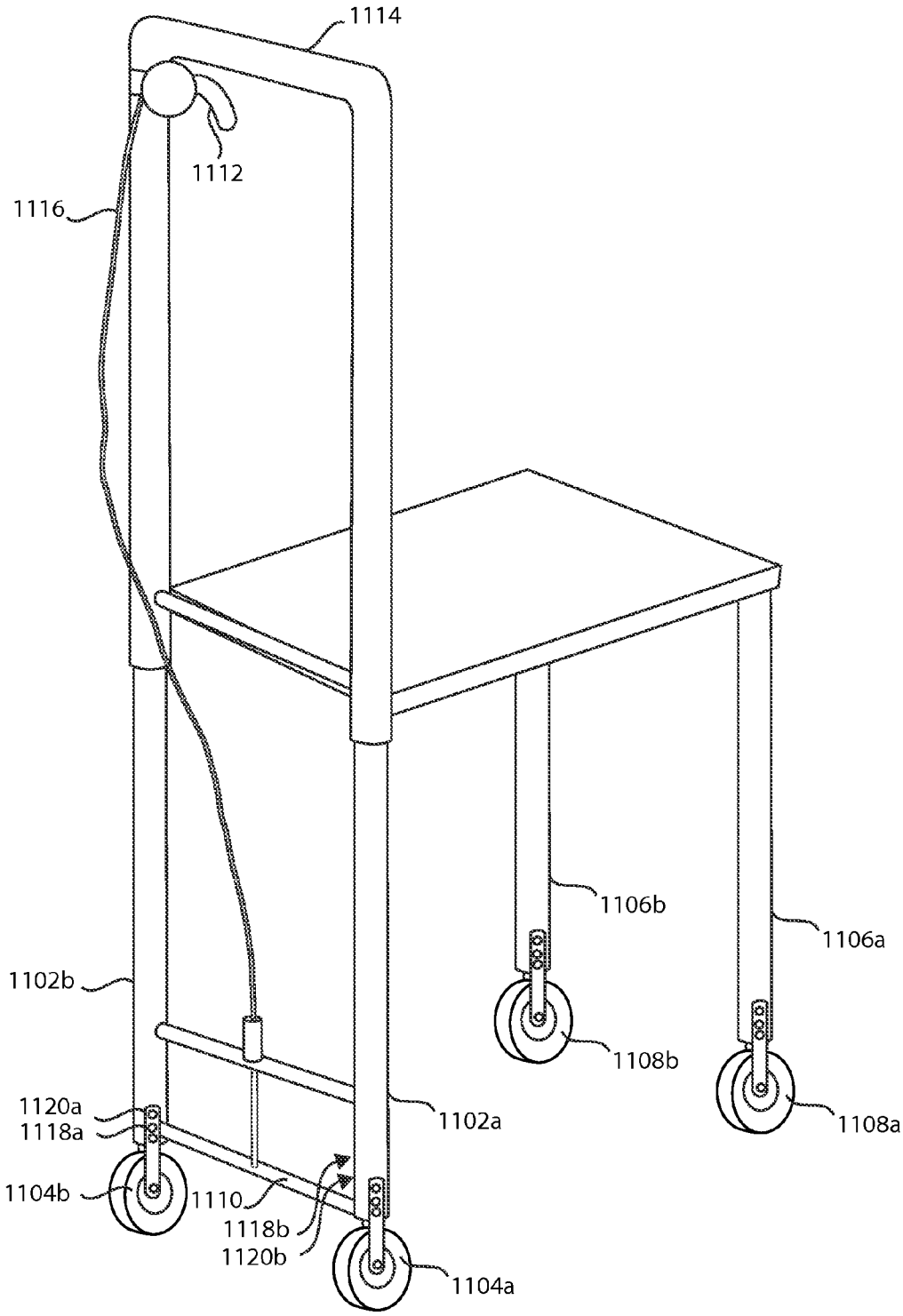
FIG. 11 is an oblique angle view of a preferred embodiment of the present invention, showing an adaptable mobility aid device having front legs with front wheels, and rear legs with rear wheels, and a park bar.

FIG. 11 is an oblique angle view of a preferred embodiment of the present invention, showing an adaptable mobility aid device 1100 having front legs 1102*a* and 1102*b* with front wheels 1104*a* and 1104*b*, and rear legs 1106*a* and 1106*b* with rear wheels 1108*a* and 1108*b*. A park bar 1110 can be operated by a lever 1112 near the handle 1114 to lock the front wheels 1104*a* and 1104*b* to prevent their movement when the device 1100 is used on stairs, or in other situations where rolling of the device is undesirable. The lever 1112 operates a cable 1116 to disengage the park bar 1110 from the front wheels 1104*a* and 1104*b*. The park bar 1110 is normally pressed into contact with the front wheels 1104*a* and 1104*b* by springs 1118*a* and 1118*b* disposed in slots 1120*a* and 1120*b* to resist motion of the front wheels. For clarity, details of the front and rear adjustment mechanisms are omitted from FIG. 11.

Figure 12A:
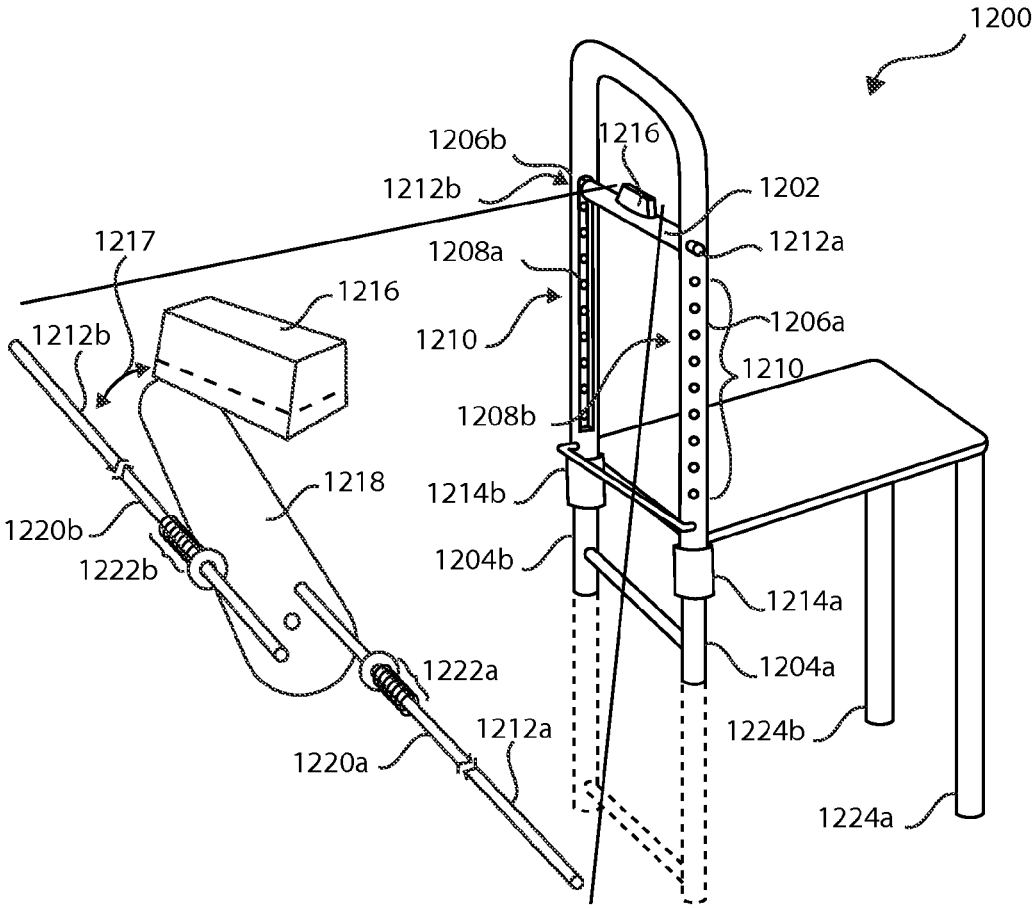
FIG. 12A is an oblique angle view of a preferred embodiment showing an adaptable mobility aid device with front leg adjustability via an adjusting bar connected to the front legs.

FIG. 12A is an oblique angle view of a preferred embodiment showing an adaptable mobility aid device 1200 with front leg adjustability via an adjusting bar 1202 connected to the front legs 1204*a* and 1204*b*, the adjusting bar acting as an adjustment mechanism 1205, as explained below. The front legs 1204*a* and 1204*b* are adapted to slide within support uprights 1206*a* and 1206*b* that include slots 1208*a* and 1208*b* to accommodate the adjusting bar 1202. The support uprights 1206*a* and 1206*b* also include apertures 1210 to receive pins 1212*a* and 1212*b* that can maintain the front legs 1204*a* and 1204*b* at a suitable length for stair use, or for use on a level walkway.

In more detail, the front legs 1204*a* and 1204*b* can slide via sleeves 1214*a* and 1214*b* within the support uprights 1206*a* and 1206*b*. Springs 1213*a* and 1213*b*, or other energy storage devices, for example, energy storage devices having pneumatic or hydraulic arrangements, provide a restoring force to the interior portions 1215*a* and 1215*b* of the front legs 1204*a* and 1204*b*, respectively, that slide within the support uprights 1206*a* and 1206*b*.

When the user on a level walkway arrives at a stairway, the user can place the device 1200 on the stairway so as to straddle both the end of the level walkway and the first step of the stairway. After the user activates the adjustment mechanism 1205, the weight of a user on the knee support platform 120 (see FIG. 1A) can force the front legs 1204*a* and 1204*b* to adjust to the appropriate leg length for stair use. When the user wished to resume motion on a level walkway, the device 100 can be converted back to flat walkway use by lifting the knee 114 (see FIG. 1A) slightly from the knee support platform 120 and activating the adjustment mechanism 1205. The springs 1213*a* and 1213*b* then can exert force against the interior portions 1215*a* and 1215*b* to extend the front legs 1204*a* and 1204*b*. In this manner the device 1200 enables single hand adjustability of the length of the front legs 1204*a* and 1204*b*.

The adjustment mechanism 1205 includes a push button 1216 on the adjusting bar 1202 that can move 1217 a cam 1218 coupled to spring-loaded rods 1220*a* and 1220*b* that end with the pins 1212*a* and 1212*b*. Motion of the cam can draw the pins 1212*a* and 1212*b* from the apertures 1210 to enable the front legs 1204*a* and 1204*b* to slide for length adjustment. The spring loading of the pins 1212*a* and 1212*b* may be accomplished, for example, by spring and flange arrangements 1222*a* and 1222*b*. It is understood that the rear legs 1224*a* and 1224*b* may be length adjustable as described above in connection with other embodiments.

Figure 12B:
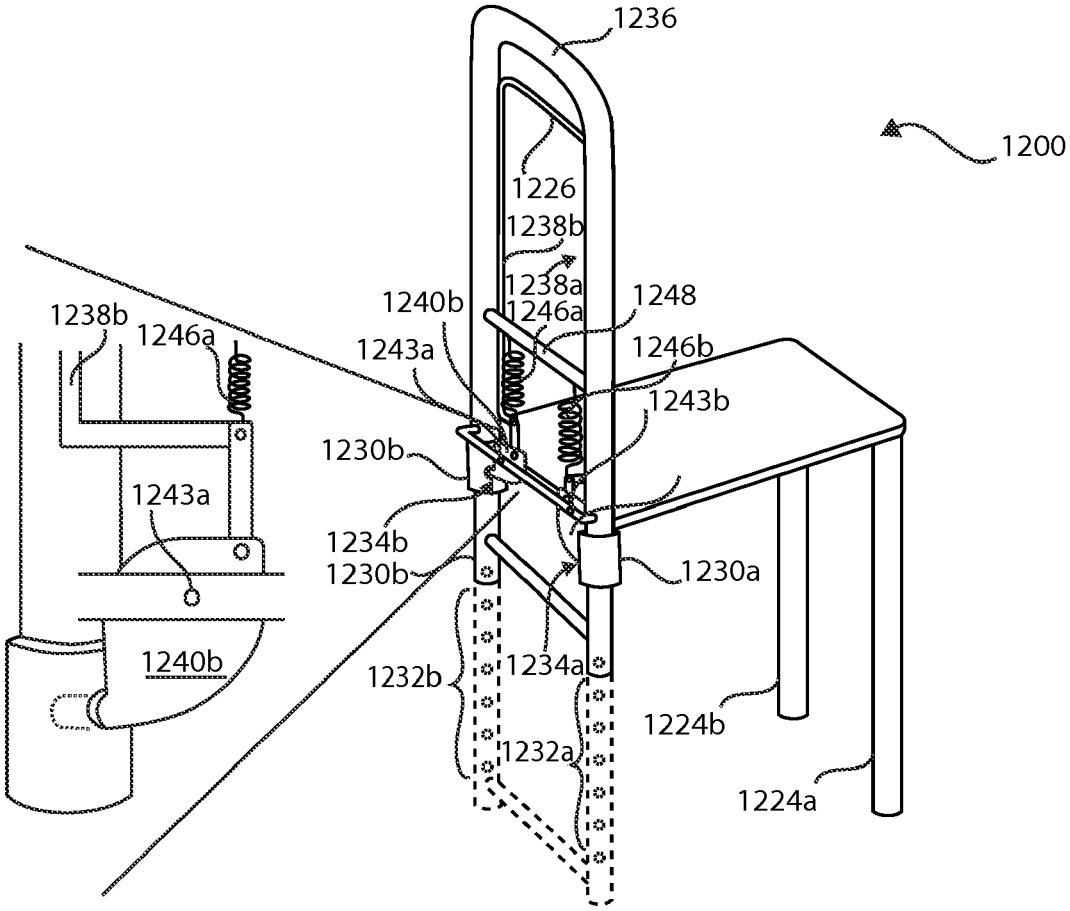
FIG. 12B is an oblique angle view of a preferred embodiment, showing an adaptable mobility aid device having front leg adjustability via an adjusting bar mounted for sliding motion on support uprights.

FIG. 12B is an oblique angle view of a preferred embodiment, similar in some respects to the embodiment of FIG. 12A, showing an adaptable mobility aid device 1200' having front leg adjustability via an adjusting bar 1226 mounted for sliding motion on support uprights 1228*a* and 1228*b*. The front legs 1230*a* and 1230*b* are adapted to slide within the support uprights 1228*a* and 1228*b*, and include apertures, some of which are shown in dashed outline at 1232*a* and 1232*b*, that can mate with pins 1234*a* and 1234*b* operated via the adjusting bar 1226. The apertures 1232*a* and 1232*b* and pins 1234*a* and 1234*b* can maintain the front legs 1230*a* and 1230*b* at a suitable length for stair use, or for use on a level walkway. The adjusting bar 1226 is mounted near a handle 1236 for convenience of use.

As discussed above in connection with FIG. 12A, the front legs 1204*a* and 1204*b* can slide via sleeves 1214*a* and 1214*b* within the support uprights 1206*a* and 1206*b*. Springs 1213*a* and 1213*b*, or other energy storage devices, for example, energy storage devices having pneumatic or hydraulic arrangements, provide a restoring force to the interior portions 1215*a* and 1215*b* of the front legs 1204*a* and 1204*b*, respectively, that slide within the support uprights.

When the user on a level walkway arrives at a stairway, the user can place the device 1200 on the stairway so as to straddle both the end of the level walkway and the first step of the stairway. After the user activates the adjustment mechanism, the weight of a user on the knee support platform can force the front legs to adjust to the appropriate leg length for stair use. When the user wished to resume motion on a level walkway, the device 100 can be converted back to flat walkway use by lifting the knee xxx slightly from the knee support platform and activating the adjustment mechanism. The springs 1213*a* and 1213*b* then can exert force against the interior portions 1215*a* and 1215*b* to extend the front legs 1204*a* and 1204*b*. In this manner the device 1200 enables single hand adjustability of the length of the front legs.

The adjusting bar 1226 is coupled to the pins 1234*a* and 1234*b* by rods 1238*a* and 1238*b* mounted on the support uprights 1228*a* and 1228*b* and capable of sliding motion along the support uprights. The rods 1238*a* and 1238*b* are pivotally connected to motion transfer plates 1240*a* and 1240*b* on which the pins 1234*a* and 1234*b* are mounted. The motion transfer plates 1240*a* and 1240*b* are mounted on a cross member 1242 at pivots 1243*a* and 1243*b*. An upward motion of the adjusting bar 1226 can thus result in rotation 1244 of the motion transfer plates 1240*a* and 1240*b* to withdraw the pins 1234*a* and 1234*b* from apertures in the front legs 1230*a* and 1230*b* currently mated with the pins, thus enabling the front legs to slide for length adjustability. Springs 1246*a* and 1246*b* coupled to an anchor member 1248 and to the motion transfer plates 1240*a* and 1240*b* provide a restoring force to allow the pins 1234*a* and 1234*b* to once again mate with available apertures on the front legs 1230*a* and 1230*b*. It is understood that the rear legs 1224*a* and 1224*b* may be length adjustable as described above in connection with other embodiments. It will also be appreciated that springs similar to 1213*a* and 1213*b* may be included in an adjustment mechanism for the rear legs 1224*a* and 1224*b*.

Figure 13:
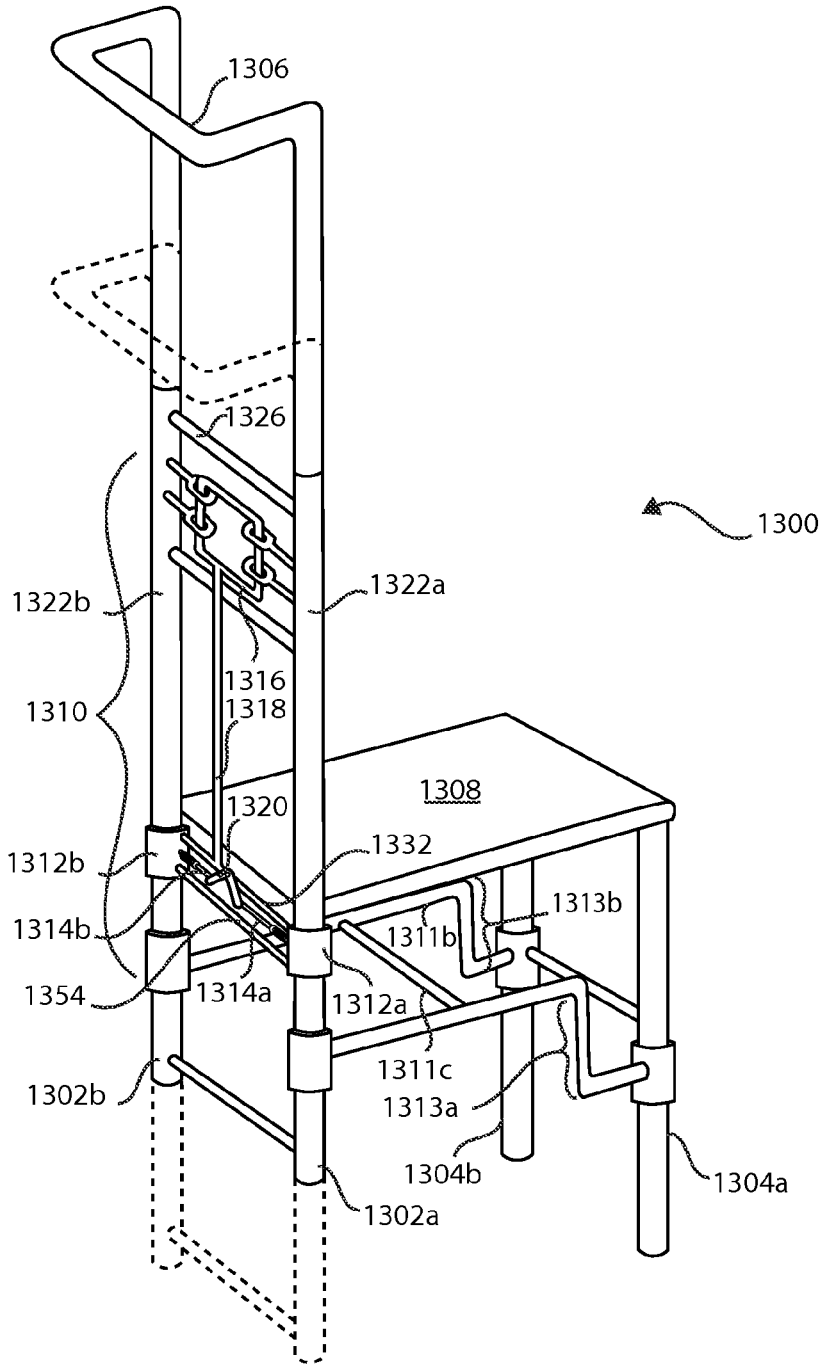
FIG. 13 is an oblique angle view of a preferred embodiment showing front leg adjustability via a release handle coupled by a cable to spring loaded pins.

FIG. 13 is an oblique angle view of an embodiment of the present invention, showing an adaptable mobility aid device 1300 that affords single hand adjustability of the front legs 1302*a* and 1302*b* via a release handle coupled by a cable to spring loaded pins. The device 1300 also includes rear legs 1304*a* and 1304*b*, a handle 1306, a knee support platform 1308, and an adjustment mechanism 1310. The rear legs 1304*a* and 1304*b* can also be adjustable via a rear leg adjustment mechanism, for example, one similar to rear adjustment mechanism 422 (see FIG. 4A) or rear adjustment mechanism 706 (see FIG. 7). The rear legs 1304*a* and 1304*b* are connected with the front legs 1302*a* and 1302*b* via reinforcing members 1311*a* and 1311*b* connected by a cross member 1311*c*. The reinforcing members 1311*a* and 1311*b* are shown with doglegs or offsets 1313*a* and 1313*b* that enable greater adjustability of the rear legs.

The adjustment mechanism 1310 includes adjustable couplings in sleeves 1312*a* and 1312*b*, left and right pin and spring arrangements 1314*a* and 1314*b*, respectively, and a release handle 1316 connected by a cable 1318 to a pin actuator 1320. In various embodiments a rod may be used in place of the cable 1318.

The front legs 1302*a* and 1302*b* are configured to slide within support uprights 1322*a* and 1322*b*. The front legs 1302*a* and 1302*b* are coupled with the handle 1306 so that raising the handle raises the front legs, effectively shortening them. To lengthen the legs 1302*a* and 1302*b*, the handle 1306 can be pushed down. If the adjustment mechanism 1310 is not actuated, the front legs are held in position with respect to the adjustable couplings 1312*a* and 1312*b* by the left and right pin and spring arrangements 1314*a* and 1314*b* that engages apertures in the support uprights 1322*a* and 1322*b* and apertures (not shown) in the front legs 1302*a* and 1302*b*.

Figure 13A:
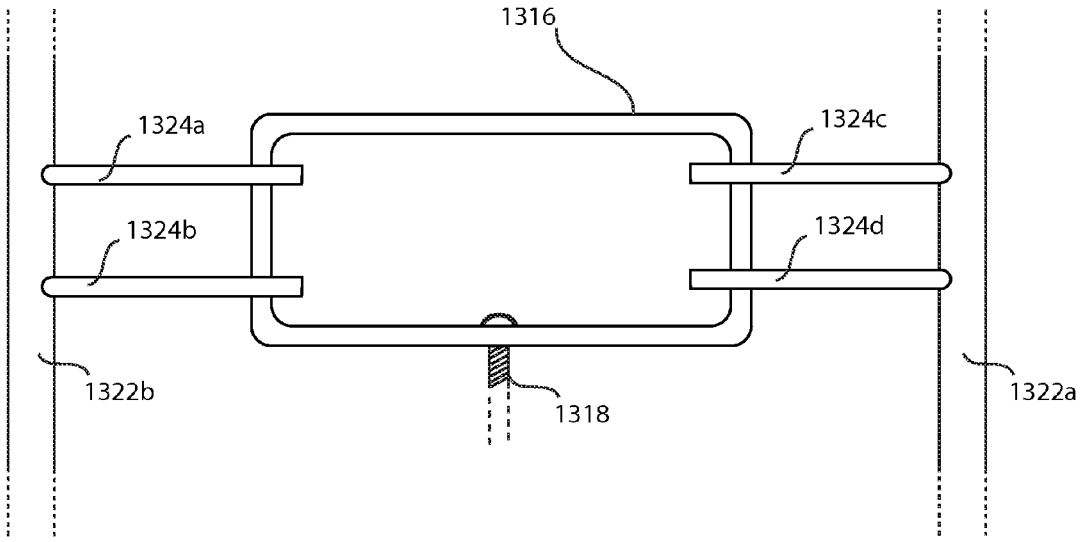
FIG. 13A is a front view showing the release handle of FIG. 13 in more detail.

The adjustment mechanism 1310 is actuated via operation of the release handle 1316. FIG. 13A is a front view showing the release handle 1316 of FIG. 13 in more detail. As shown in FIG. 13A, the release handle 1316 is slidably coupled with the support uprights 1322*a* and 1322*b* by guides 1324*a*-1324*d* coupled to the support uprights. A crossbar, referred to herein as a lower handle 1326, is coupled to the support uprights 1322*a* and 1322*b*. A user 108 (see FIG. 1A) of the device 1300 can hold both the lower handle 1326 and the release handle 1316. By squeezing the release handle 1316 toward the lower handle 1326, the user 108 can draw the release handle upward, thereby drawing the end of the cable 1318 upward.

Figure 13B:
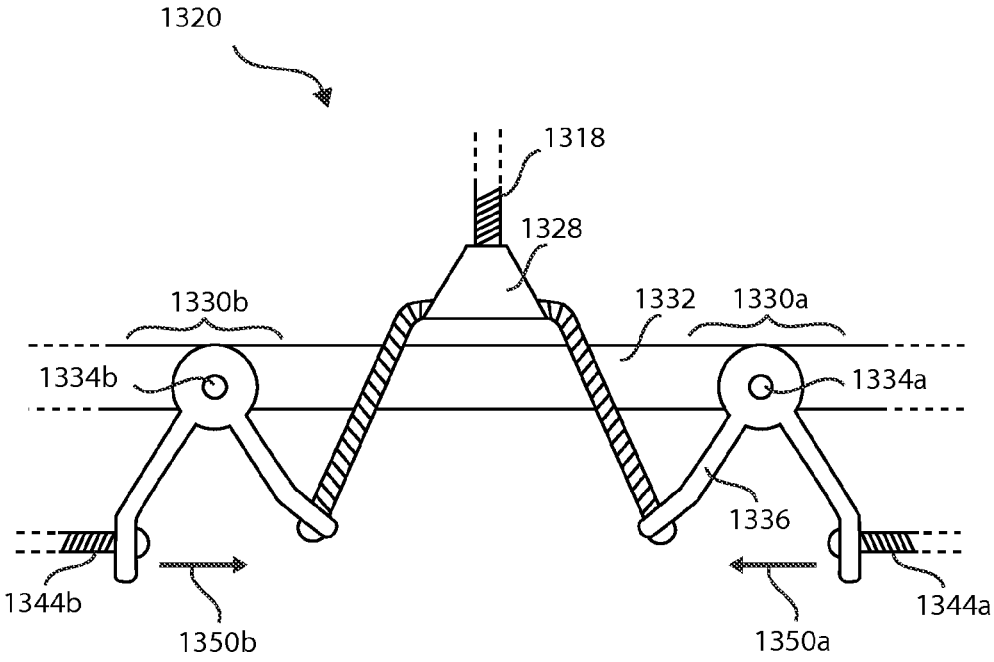
FIG. 13B is a front view showing a pin actuator of FIG. 13 in more detail.

FIG. 13B is a front view showing the pin actuator 1320 of FIG. 13 in more detail. As shown in FIG. 13B, the other end of the cable 1318 is connected to the pin actuator 1320 at a saddle 1328. The pin actuator 1320 includes a first lever 1330*a* and a second lever 1330*b* pivotably mounted to a crosspiece 1332 via pivots 1334*a* and 1334*b*.

The first lever 1344 includes a first inside arm 1336 and a first outside arm 1338. The second lever 1330*b* includes a second inside arm 1340 and a second outside arm 1342. The first outside arm 1338 secures one end of a left cable 1344*a* connected to the left pin and spring arrangement 1314*a*. The second outside arm 1342 secures one end of a right cable 1344*b* connected to the right pin and spring arrangement 1314*b*. The denotations left and right typically refer to the perspective of a user using the device 1300.

One end of a transfer cable 1346 is connected to the first inside arm 1336. The other end of the transfer cable 1346 is connected to the second inside arm 1340. The saddle 1328 holds a middle portion of the transfer cable, and thus enables transfer of force from the cable 1318 to the transfer cable 1346. In alternative embodiments the first and second levers 1330*a* and 1330*b* can be replaced with two pulleys, with a longer transfer cable that engages the two pulleys and also replaces the cables 1344*a* and 1344*b*.

With this configuration, when the user 108 (see FIG. 1A) draws the release handle 1316 upward, the cable 1318, via the transfer cable 1346, draws the inside arms 1340 and 1336 upward, which results in the outside arms 1342 and 1338 drawing the ends of the cables 1344*a* and 1344*b* toward one another and way from the their nearest supports upright 1322*a* and 1322*b*, respectively, as shown by the arrows 1350*a* and 1350*b*. The motions of the cables 1344*a* and 1344*b* are communicated to the pins of the pin and spring arrangements 1314*a* and 1314*b*, discussed next.

Figure 13C:
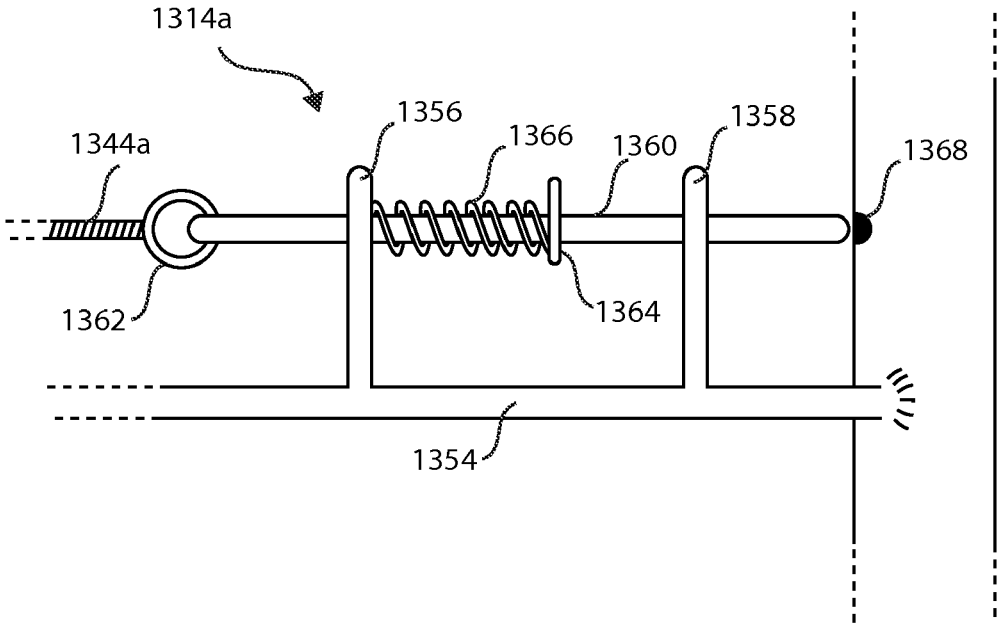
FIG. 13C is a front view showing a pin and spring arrangement of FIG. 13 in more detail.

FIG. 13C is a front view showing the pin and spring arrangement 1314*a* of FIG. 13 in more detail. As shown in FIG. 13C, the left pin and spring arrangement 1314*a* includes a holding bracket 1354 that spans the two support uprights 1322*a* and 1322*b*. The holding bracket includes two vertical members 1356 and 1358 for the left pin and spring arrangement 1314*a*, through which a pin 1360 passes. A ring 1362 at one end of the pin 1360 connects the pin with the other end of the cable 1344*a*. A spring 1366 encircles the pin 1360, and is positioned between the vertical member 1356 and a washer 1364 fixed to the pin. When the cable 1344*a* is drawn away from the support upright 1322*a* a sufficient distance, the pin 1360 is drawn out of an aperture 1368, and the washer 1364 compresses the spring 1366 against the vertical member 1356. Thus, when the pin actuator 1320 is no longer activated, that is, when the user 108 (see FIG. 1A) releases the release handle 1316, the energy stored in the compressed spring 1366 can be released, with the pin 1360 moving back into the aperture 1368. When the pin 1360 moves back into the aperture 1368, the pin can engage one of a series of apertures similar to the series 618*a* (see FIG. 6) but disposed on the leg 1302*a* so as to align with the aperture 1368, and the pin can thereby secure the left leg against sliding within the support upright 1322*a*. The right pin and spring arrangement 1314*b* is configured similarly.

In other embodiments, interior springs 1213*a* and 1213*b* (see FIG. 12A), or other energy storage devices, for example, energy storage devices having pneumatic or hydraulic arrangements, provide a restoring force to interior portions 1215*a* and 1215*b* of the front legs 1302*a* and 1302*b*, respectively, that slide within the support uprights 1322*a* and 1322*b*.

Thus, in these other embodiments, when the user 108 (see FIG. 1A) on a level walkway arrives at a stairway, the user can place the device 1300 on the stairway so as to straddle both the end of the level walkway and the first step of the stairway. After the user activates the adjustment mechanism 1310, the weight of a user on the knee support platform 1308 can force the front legs 1302*a* and 1302*b* to adjust to the appropriate leg length for stair use. When the user 108 wishes to resume motion on a level walkway, the device 1300 can be converted back to flat walkway use by lifting the knee 114 slightly from the knee support platform 1308 and activating the adjustment mechanism 1310. The springs 1213*a* and 1213*b* (see FIG. 12A) then can exert force against the interior portions 1215*a* and 1215*b* of the front legs 1302*a* and 1302*b* to extend the front legs. In this manner the device 1300 enables single hand adjustability of the length of the front legs 1302*a* and 1302*b*.

Figure 14:
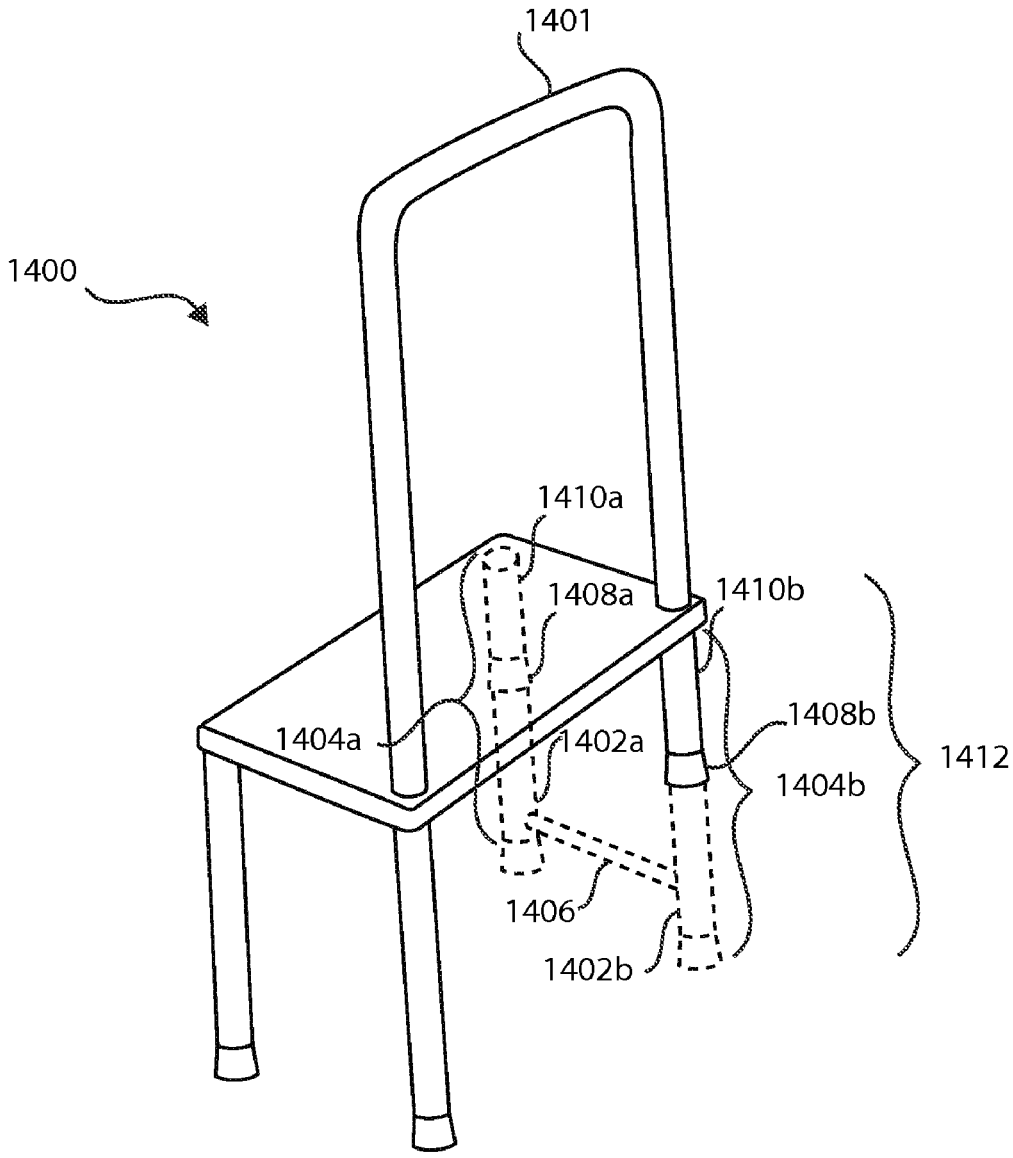
FIG. 14 is an oblique angle view of a preferred embodiment similar to that shown in FIG. 5, but with the handle on the side of the device, rather than on the front.

FIG. 14 is an oblique angle view of a preferred embodiment similar to that shown in FIG. 5, but with the handle 1401 on the side of the device 1400, rather than on the front. As with the embodiment of FIG. 5, the front legs 1404*a* and 1404*b* may be attachable and detachable manually, for example, by using a cross bar to manipulate lower, detachable portions of the legs in tandem. In FIG. 14, the lower portions 1402*a* and 1402*b* of the front legs 1404*a* and 1404*b* are joined with a cross bar 1406 to form an H-shaped structure, so that the lower portions of the front legs may be removed from corresponding sleeves 1408*a* and 1408*b* in the upper portions 1410*a* and 1410*b* of the front legs by pulling on the cross bar, thus shortening the front legs for use on stairs. Conversely, the legs can be lengthened by reversing the process to restore the lower portions 1402*a* and 1402*b* of the front legs 1304*a* and 1404*b* to nest in the sleeves 1408*a* and 1408*b*, so that the front legs 1404*a* and 1404*b* are of a length suitable for use on a level walkway. In this way the cross bar 1406, sleeves 1408*a* and 1408*b*, and nesting lower portions 1402*a* and 1402*b* together comprise an adjustable coupling 1412 that is single-hand operable to adjust the length of the front legs 1404*a* and 1404*b*.

An adaptable mobility aid device for use on a level walkway or on stairs has been described. The device has length-adjustable front and rear legs, a handle, and a knee support platform coupled to the legs and the handle, so that lengths of the legs can be adjusted in tandem via single-hand operability of an adjustment mechanism. The legs can be adjusted within a range of lengths suitable for walking on a level or inclined walkway, and for ascending and descending stairs. The adaptable mobility aid device includes a knee support platform that, during stairway use, can straddle or span two steps, to better distribute the user's weight during ascent or descent of stairs. The device also includes an adjustment mechanism that can be activated with a single hand to enable length adjustability of the front legs for conversion between use on a level walkway and use on stairs. Embodiments of the invention provide the benefit of increased usability of the device and increased stability of a user during stairway use. Moreover, embodiments of the invention provide the further the further benefit of single hand operability of the adjustment mechanism.

Other modifications and implementations will occur to those skilled in the art without departing from the spirit and the scope of the invention as claimed. Accordingly, the above description is not intended to limit the invention except as indicated in the following claims.

What is claimed is:

1. An adaptable mobility aid device, comprising:

a knee support platform;

a handle coupled to the knee support platform;

a pair of front legs including a left front leg and a right front leg, and a pair of rear legs including a left rear leg and a right rear leg, the pair of front legs and the pair of rear legs all being configured to engage a walking surface by frictional contact;

a first adjustability mechanism configured to enable single-hand length adjustment of one of the pair of front legs and the pair of rear legs, such that both legs of said one of the pair of front legs and the pair of rear legs are length-adjustable together, using a single hand, between:

a first length position for use of the device on stairs, in which the pair of front legs are configured to engage one of an upper step and a lower step while the pair of rear legs are configured to engage the other of the upper step and the lower step, and while the knee support platform is disposed substantially horizontally; and a second length position for use of the device on a level walkway, in which the pair of front legs and the pair of rear legs are all configured to engage the level walkway at the same time while the knee support platform is disposed substantially horizontally.

2. The device of claim 1, wherein the knee support platform has a contoured upper surface.

3. The device of claim 1, wherein the knee support platform is adapted for use as a seat.

4. The device of claim 3, wherein the device further comprises a seat backrest.

5. The device of claim 1, in which the first adjustability mechanism is configured to enable single-hand length adjustment of the pair of front legs together, the device including a second adjustability mechanism configured to enable single-hand length adjustability of the pair of rear legs together.

6. The device of claim 1, further comprising a second adjustability mechanism, wherein the first adjustability mechanism is configured to enable single-hand length adjustment of the pair of front legs together, and the second adjustability mechanism is configured to enable single-hand length adjustment of the pair of rear legs together.

7. The device of claim 6, wherein:

the first adjustability mechanism includes an adjustable coupling configured to be single-hand operable; and each of the left front leg and the right front leg includes a respective sleeve portion and a respective nesting portion coupled to the respective sleeve portion via the adjustable coupling.

8. The device of claim 1, wherein the first adjustability mechanism is configured to enable adjustment of the pair of front legs, and includes:

a pair of sleeves coupled to the knee support platform, each sleeve configured to receive a corresponding leg of the pair of front legs for sliding motion;

a series of apertures defined in each of the pair of front legs;

a pair of pins, a pin disposed in each of the pair of sleeves, each of the pins configured to engage one aperture of the series of apertures defined in a corresponding one of the pair of front legs so as to secure the corresponding one of the pair of front legs against movement with respect to a corresponding sleeve of the pair of sleeves; and a spring-loaded bar coupled to the pair of pins, and configured so that when the bar is actuated each of the pins is disengaged from its aperture.

9. The device of claim 1, wherein the pair of front legs, the pair of rear legs, and the knee support platform are configured to enable collapsibility of the device.

10. The device of claim 9, wherein the knee support platform is pivotally attached to the pair of front legs and the pair of rear legs, the device further comprising:

a left crossbrace pivotally connected with the left front leg and pivotally attached to the left rear leg, the left crossbrace including a pivot within a central portion of the left crossbrace to enable bending of the left crossbrace;

a right crossbrace pivotally connected with the right front leg and pivotally attached to the right rear leg, the right crossbrace including a pivot within a central portion of the right crossbrace to enable bending of the right crossbrace; and a rod having a left end and a right end, the rod connected to the left crossbrace at the left end to form the pivot of the left crossbrace, and connected to the right crossbrace at the right end to form the pivot of the right crossbrace, wherein a motion of the rod to cause bending of the left crossbrace and the right crossbrace enables folding of the device for storage.

11. The device of claim 10, further comprising:

a left floating clamp pivotally attached to the left crossbrace and configured to encircle the left front leg to enable sliding motion of the left front leg within the left floating clamp; and a right floating clamp pivotally attached to the right crossbrace and configured to encircle the right front leg to enable sliding motion of the right front leg within the right floating clamp;

wherein when a motion of the rod causes bending of the left crossbrace and the right crossbrace, the knee support platform is configured to fold, with sliding motion of the front legs within the corresponding floating clamps, so as to bring the rear legs close to the front legs for storage.

12. An adaptable mobility aid device, comprising:

a pair of front legs configured to engage a walking surface by frictional contact, the pair of front legs being length-adjustable, the pair of front legs capable of adjustment to a first length for use on stairs and to a second length for use on a level walkway;

a front adjustability mechanism configured to enable length adjustability of the pair of front legs together via single-hand operability;

a pair of rear legs configured to engage the walking surface by frictional contact, the pair of rear legs being length-adjustable;

a rear adjustability mechanism configured to enable length adjustability of the pair of rear legs via single-hand operability;

a back support frame coupled to the pair of front legs;

a knee support platform coupled to the pair of front legs, coupled to the pair of rear legs, and coupled to the back support frame; and a handle coupled to the back support frame.

13. The device of claim 12, wherein:

the back support frame includes a pair of support uprights coupled to the front legs and coupled to the handle, each of the support uprights defining an inside slot and a series of spaced apertures;

the front legs are further configured to slide into the support uprights to enable length adjustability; and the front adjustability mechanism comprises:

an adjusting bar coupled to the front legs;

a pair of spring-loaded pins, normally engaged with a pair of apertures; and an actuator disposed on the adjusting bar and configured to disengage the pins from the apertures;

the device further comprising:

a pair of springs disposed within the support uprights and configured to provide resisting force against shortening the length of the front legs.

14. The device of claim 12, wherein:

the back support frame includes a left support upright and a right support upright coupled to the front legs and coupled to the handle, each of the support uprights defining an inside slot and an aperture;

the left front leg defines a left series of spaced apertures;

the right front leg defines a right series of spaced apertures;

the front legs are further configured to slide into the support uprights to enable length adjustability; and the front adjustability mechanism comprises:

an adjusting bar coupled to the front legs;

a left spring-loaded pin and a right spring-loaded pin, the left pin engaged with the aperture on the left support upright and normally engaged with an aperture of the left series of apertures, the right pin engaged with the aperture on the right support upright and normally engaged with an aperture of the right series of apertures; and an actuator disposed between the support uprights for sliding motion and configured to disengage the left spring-loaded pin from the aperture of the left series of apertures, and to disengage the right spring-loaded pin from the aperture of the right series of apertures;

the device further comprising:

a pair of springs disposed within the support uprights and configured to provide resisting force against shortening the length of the front legs.

15. The device of claim 12, wherein:

the knee support platform has a flat upper surface; and the knee support platform is adapted for use as a seat.

16. The device of claim 12, wherein the handle is on an opposite side of the knee support platform as a user when the device is in use for walking or climbing.

17. The device of claim 12, further comprising:

a back support surface coupled to the back support frame;

wherein:

the pair of front legs is length-adjustable in tandem;

the pair of rear legs is length-adjustable in tandem; and the knee support platform is adapted for use as a seat.

18. The device of claim 12, further comprising:

a pair of sleeves coupled to the pair of front legs; and an adjustable coupling;

wherein:

each of the pair of front legs includes a nesting portion coupled to its corresponding sleeve portion via the adjustable coupling; and the adjustable coupling is single-hand operable.

19. An adaptable mobility aid device, comprising:

a knee support platform;

a handle coupled to the knee support platform;

a pair of rear legs coupled to the knee support platform;

a pair of rear wheels coupled to the pair of rear legs, the pair of rear legs configured to engage a walking surface by rolling contact;

a pair of front legs coupled to the knee support platform, the pair of front legs being length-adjustable for use of the device on stairs, for use on a ramp, and for use on a level walkway, and the pair of front legs configured so that, when the device is used on stairs, the front legs engage an upper step and the rear legs engage an adjacent lower step so as to support the knee support platform in a position over a portion of the upper step and over a portion of the adjacent lower step, and with the knee support platform disposed approximately horizontally;

a pair of front wheels coupled to the pair of front legs, the pair of front wheels configured to engage the walking surface by rolling contact;

a brake coupled with the front legs, the brake configured for user operability to prevent rolling of the front wheels when the device is used on stairs, the brake comprising a park bar, the park bar being spring-loaded so that the front wheels are normally prevented from rolling;

a cable coupled to the park bar, the cable configured to enable disengagement of the park bar from the front wheels to enable rolling of the front wheels; and a hand lever disposed near the handle, the hand lever coupled to the cable and configured to enable locking of the park bar via the cable to disengage the park bar from the front wheels, and further configured to enable unlocking of the park bar via the cable to engage the park bar with the front wheels.

20. An adaptable mobility aid device, comprising:

a knee support platform;

a handle coupled to the knee support platform;

a pair of rear legs, including a left rear leg and a right rear leg, configured to engage a walking surface by frictional contact and pivotally attached to the knee support platform;

a pair of front legs, including a left front leg and a right front leg, configured to engage a walking surface by frictional contact and pivotally attached to the knee support platform, the a pair of front legs being length-adjustable between:

a first length position for use of the device on stairs, the at least one front leg at its first length position being configured to engage an upper step while the rear leg engages a lower step, thereby enabling the knee support platform to be disposed substantially horizontally; and a second length position for use of the device on a level walkway;

a left crossbrace pivotally connected with the left front leg and pivotally attached to the left rear leg, the left crossbrace including a pivot within a central portion of the left crossbrace to enable bending of the left crossbrace;

a right crossbrace pivotally connected with the right front leg and pivotally attached to the right rear leg, the right crossbrace including a pivot within a central portion of the right crossbrace to enable bending of the right crossbrace; and a rod having a left end and a right end, the rod connected to the left crossbrace at the left end to form the pivot of the left crossbrace, and connected to the right crossbrace at the right end to form the pivot of the right crossbrace;

wherein the pair of rear legs, the pair of front legs, and the knee support platform are configured to enable collapsibility of the device, and a motion of the rod to cause bending of the left crossbrace and the right crossbrace enables folding of the device for storage.

* * * * *